US010621922B2

(12) United States Patent
Oh et al.

(10) Patent No.: US 10,621,922 B2
(45) Date of Patent: Apr. 14, 2020

(54) DISPLAY APPARATUS AND METHOD OF OPERATING THE SAME

(71) Applicant: SAMSUNG DISPLAY CO., LTD., Yongin-si, Gyeonggi-Do (KR)

(72) Inventors: Hyun-Uk Oh, Seongnam-si (KR); Ji-Tae Kim, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 15/459,657

(22) Filed: Mar. 15, 2017

(65) Prior Publication Data

US 2018/0025683 A1 Jan. 25, 2018

(30) Foreign Application Priority Data

Jul. 22, 2016 (KR) ..... 10-2016-0093625

(51) Int. Cl.
*G09G 3/3291* (2016.01)
*G09G 3/3233* (2016.01)
*G09G 3/3258* (2016.01)

(52) U.S. Cl.
CPC ..... *G09G 3/3291* (2013.01); *G09G 3/3233* (2013.01); *G09G 3/3258* (2013.01); *G09G 2300/043* (2013.01); *G09G 2300/0408* (2013.01); *G09G 2300/0842* (2013.01); *G09G 2300/0861* (2013.01); *G09G 2320/0238* (2013.01); *G09G 2320/0271* (2013.01); *G09G 2320/0295* (2013.01); *G09G 2340/16* (2013.01); *G09G 2360/16* (2013.01)

(58) Field of Classification Search
CPC ..... G09G 3/30–3291
See application file for complete search history.

(56) References Cited

U.S. PATENT DOCUMENTS

| | | | | |
|---|---|---|---|---|
| 7,113,227 | B1 * | 9/2006 | Kakuya | G09G 5/10 348/255 |
| 9,076,748 | B2 * | 7/2015 | Kim | H01L 27/3276 |
| 9,324,264 | B2 * | 4/2016 | Jeong | G09G 3/3233 |
| 9,396,677 | B2 * | 7/2016 | Park | G09G 3/3225 |
| 9,502,488 | B2 * | 11/2016 | Hwang | H01L 27/3276 |
| 9,576,532 | B2 * | 2/2017 | Lee | G09G 3/3233 |
| 9,728,134 | B2 * | 8/2017 | Jeong | G09G 3/3233 |
| 9,767,732 | B2 * | 9/2017 | Park | G09G 3/3258 |
| 9,773,465 | B2 * | 9/2017 | Sohn | G09G 3/3614 |
| 9,898,963 | B2 * | 2/2018 | Lee | G09G 3/3291 |
| 9,905,165 | B2 * | 2/2018 | Park | G09G 3/3258 |
| 10,032,405 | B2 * | 7/2018 | Jeong | G09G 3/2051 |
| 2006/0187176 | A1 * | 8/2006 | Yang | G09G 3/3659 345/100 |

(Continued)

OTHER PUBLICATIONS

European Search Report dated Dec. 4, 2017 in corresponding European Patent Application No. 17182749.6.

*Primary Examiner* — Patrick F Marinelli
(74) *Attorney, Agent, or Firm* — F. Chau & Associates, LLC

(57) ABSTRACT

A display apparatus includes a display panel and a panel driver. The display panel includes a first pixel including a first organic light emitting diode (OLED). The panel driver applies a first voltage to an anode electrode of the first OLED while a first frame image is displayed on the display panel if a grayscale of the first frame image is lower than a first reference grayscale.

22 Claims, 32 Drawing Sheets

(56) References Cited

U.S. PATENT DOCUMENTS

2008/0136767 A1* 6/2008 Kim ..... G09G 3/3648 345/101
2008/0291339 A1* 11/2008 Mamba ..... G09G 3/3614 348/739
2011/0134100 A1 6/2011 Chung et al.
2012/0127191 A1* 5/2012 Choi ..... G09G 3/3648 345/589
2013/0201172 A1* 8/2013 Jeong ..... G09G 3/3233 345/212
2013/0241811 A1* 9/2013 White ..... G09G 3/30 345/77
2014/0139565 A1* 5/2014 Choi ..... G09G 3/2018 345/691
2014/0375699 A1* 12/2014 Park ..... G09G 3/3225 345/690
2015/0022514 A1* 1/2015 Lee ..... G09G 3/3233 345/212
2015/0035866 A1* 2/2015 Ahn ..... G09G 5/10 345/690
2015/0108482 A1* 4/2015 Kim ..... H01L 27/3276 257/71
2015/0371606 A1* 12/2015 Lee ..... G09G 3/3233 345/690
2016/0012775 A1 1/2016 Jeong et al.
2016/0035283 A1* 2/2016 Park ..... G09G 3/3258 345/214
2016/0071454 A1* 3/2016 Sohn ..... G09G 3/3614 345/212
2016/0071461 A1* 3/2016 Lee ..... G09G 3/3291 345/76
2016/0078849 A1* 3/2016 Furihata ..... G09G 5/363 345/211
2016/0079331 A1* 3/2016 Hwang ..... H01L 27/3276 257/40
2016/0093263 A1 3/2016 Kimura et al.
2016/0141350 A1 5/2016 Kim et al.
2016/0163243 A1* 6/2016 Park ..... G09G 3/3258 345/205
2016/0240142 A1* 8/2016 Jeong ..... G09G 3/3233
2016/0329016 A1* 11/2016 Chaji ..... G09G 3/3225
2017/0069244 A1* 3/2017 Lim ..... G09G 3/2003
2017/0084227 A1* 3/2017 Bae ..... G09G 3/3275
2017/0098407 A1* 4/2017 Jeong ..... G09G 3/2051
2017/0186375 A1* 6/2017 Jung ..... G09G 3/3258
2017/0249882 A1* 8/2017 Lee ..... G09G 3/006
2017/0330515 A1* 11/2017 Jeong ..... G09G 3/3233
2017/0331061 A1* 11/2017 Lee ..... H01L 27/10882
2017/0345883 A1* 11/2017 Song ..... H01L 27/3258
2018/0025683 A1* 1/2018 Oh ..... G09G 3/2018 345/690
2018/0350299 A1* 12/2018 Chaji ..... G09G 3/3225

* cited by examiner

DISPLAY APPARATUS AND METHOD OF OPERATING THE SAME

CROSS-REFERENCE TO RELATED APPLICATION

This application claims priority under 35 USC § 119 to Korean Patent Application No. 10-2016-0093625, filed on Jul. 22, 2016 in the Korean Intellectual Property Office (KIPO), the disclosure of which is incorporated by reference in its entirety herein.

BACKGROUND

1. Technical Field

Exemplary embodiments of the inventive concept relate generally to displaying images, and more particularly to display apparatuses and methods of operating the display apparatuses.

2. Discussion of Related Art

An organic light emitting display apparatus displays images using organic light emitting diodes ("OLEDs"). The OLED generally includes an organic layer located between an anode and a cathode. Holes from the anode may be combined with electrons from the cathode in the organic layer between the anode and the cathode to emit light.

The organic light emitting display apparatus includes red pixels outputting red light, green pixels outputting green light, and blue pixels outputting blue light. A driving duration of a pixel among the colored pixels may vary depending on the color output by the pixel. The driving duration may decrease as the display resolution of the organic light emitting display apparatus increases. However, a display defect may be visible on the organic light emitting display apparatus when a low gray scale image or a changing image is presented due to a luminance deficit in some of the pixels.

SUMMARY

At least one exemplary embodiment of the inventive concept provides a display apparatus capable of having an improved display quality and a method of driving the display apparatus.

According to an exemplary embodiment of the inventive concept, a display apparatus includes a display panel and a panel driver. The display panel includes a first pixel including a first organic light emitting diode (OLED). The panel driver applies a first voltage to an anode electrode of the first OLED while a first frame image is displayed on the display panel if a grayscale of the first frame image is lower than a first reference grayscale.

In an exemplary embodiment, the first voltage is an initialization voltage for resetting the first OLED.

In an exemplary embodiment, the first pixel further includes a first transistor, the first transistor is connected between the anode electrode of the first OLED and a node receiving the initialization voltage, and has a gate electrode receiving a first initialization control signal.

In an exemplary embodiment, the panel driver includes a data driver and an initialization controller, the data driver generates a first data signal based on image data corresponding to the first frame image, and the initialization controller generates the first initialization control signal by checking the grayscale of the first frame image based on the first data signal.

In an exemplary embodiment, the initialization controller includes a comparator, the comparator includes a first input terminal receiving the first data signal, a second input terminal receiving a first reference signal corresponding to the first reference grayscale, and an output terminal outputting the first initialization control signal.

In an exemplary embodiment, when a voltage level of the first data signal is higher than a voltage level of the first reference signal, the initialization controller determines that the grayscale of the first frame image is lower than the first reference grayscale to activate the first initialization control signal, and the initialization voltage is applied to the anode electrode of the first OLED when the first initialization control signal is activated.

In an exemplary embodiment, the initialization controller is disposed on the display panel.

In an exemplary embodiment, the initialization controller is disposed in the data driver.

In an exemplary embodiment, the panel driver applies the first voltage to the anode electrode of the first OLED while the first frame image is displayed on the display panel if the grayscale of the first frame image is lower than the first reference grayscale and if a grayscale of a second frame image is higher than a second reference grayscale, and the first and second frame images are two consecutive images.

In an exemplary embodiment, the panel driver modifies the first frame image if the grayscale of the first frame image is lower than the first reference grayscale and if the grayscale of the second frame image is higher than the second reference grayscale.

According to an exemplary embodiment of the inventive concept, a method of operating a display apparatus including a display panel including a first pixel includes: comparing a grayscale of a first frame image displayed on the display panel with a first reference grayscale; and applying a first voltage to an anode electrode of a first organic light emitting diode (OLED) included in the first pixel while the first frame image is displayed on the display panel if a result of the comparing indicates the grayscale of the first frame image is lower than the first reference grayscale.

In an exemplary embodiment, the first voltage is an initialization voltage for resetting the first OLED.

In an exemplary embodiment, in comparing the grayscale of the first frame image with the first reference grayscale, a first data signal is generated based on image data corresponding to the first frame image, and a first initialization control signal is generated by comparing the first data signal with a first reference signal corresponding to the first reference grayscale.

In an exemplary embodiment, when a voltage level of the first data signal is higher than a voltage level of the first reference signal, it is determined that the grayscale of the first frame image is lower than the first reference grayscale to activate the first initialization control signal, and the initialization voltage is applied to the anode electrode of the first OLED when the first initialization control signal is activated.

In an exemplary embodiment, a grayscale of a second frame image displayed on the display panel is further compared with a second reference grayscale, the first and second frame images are two consecutive images, and the first voltage is applied to the anode electrode of the first OLED while the first frame image is displayed on the display panel if the grayscale of the first frame image is lower than the first reference grayscale and if the grayscale of the second frame image is higher than the second reference grayscale.

According to an exemplary embodiment of the inventive concept, a display apparatus includes a display panel and a panel driver. The display panel includes a first organic light emitting diode (OLED) and a first initialization circuit connected to the first OLED. The panel driver generates a first initialization control signal by comparing a grayscale of a first partial image displayed on the first pixel with a first reference grayscale. When the first initialization control signal is activated, the first initialization unit is enabled and an initialization voltage is applied to the first OLED while the first partial image is displayed on the first pixel.

In an exemplary embodiment, the panel driver activates the first initialization control signal if the grayscale of the first partial image is lower than the first reference grayscale.

In an exemplary embodiment, the panel driver determines that the grayscale of the first partial image is lower than the first reference grayscale if a voltage level of a first data signal corresponding to the first partial image is higher than a voltage level of a first reference signal corresponding to the first reference grayscale.

In an exemplary embodiment, the panel driver generates the first initialization control signal by comparing the grayscale of the first partial image with the first reference grayscale, and by comparing a grayscale of a second partial image displayed on the first pixel with a second reference grayscale, and the first and second partial images are two consecutive images.

In an exemplary embodiment, the panel driver activates the first initialization control signal if the grayscale of the first partial image is lower than the first reference grayscale, and if the grayscale of the second partial image is higher than the second reference grayscale.

In an exemplary embodiment, the panel driver includes a data driver and an initialization controller, the data driver generates a first data signal corresponding to the first partial image based on image data, and the initialization controller generates the first initialization control signal by checking the grayscale of the first partial image based on the first data signal.

In an exemplary embodiment, the initialization controller includes a comparator, the comparator includes a first input terminal receiving the first data signal, a second input terminal receiving a first reference signal corresponding to the first reference grayscale, and an output terminal outputting the first initialization control signal.

In an exemplary embodiment, the initialization controller is disposed on the display panel.

In an exemplary embodiment, the initialization controller is disposed in the data driver.

In an exemplary embodiment, the first initialization circuit includes a first transistor, the first transistor is connected between an anode electrode of the first OLED and a node receiving the initialization voltage, and has a gate electrode receiving the first initialization control signal.

In an exemplary embodiment, the initialization voltage is applied to the anode electrode of the first OLED.

According to an exemplary embodiment of the inventive concept, a display apparatus includes a display panel and a panel driver. The display panel includes a plurality of pixels. The panel driver modifies a first frame image displayed on the display panel if a grayscale of the first frame image is lower than a first reference grayscale and if a grayscale of a second frame image displayed on the display panel is higher than a second reference grayscale. The first and second frame images are two consecutive images.

In an exemplary embodiment, the panel driver increases the grayscale of the first frame image to a first grayscale if the grayscale of the first frame image is lower than the first reference grayscale and if the grayscale of the second frame image is higher than the second reference grayscale.

In an exemplary embodiment, the panel driver increases a grayscale of a first region in the first frame image to a first grayscale if the grayscale of the first region in the first frame image is lower than the first reference grayscale and if a grayscale of a first region in the second frame image is higher than the second reference grayscale, and the first region in the second frame image corresponds to the first region in the first frame image.

In an exemplary embodiment, the panel driver increases the grayscale of the first region in the first frame image to the first grayscale and increases a grayscale of a second region in the first frame image to a second grayscale if the grayscale of the second region in the first frame image is substantially equal to the first grayscale, the second region in the first frame image is different from the first region in the first frame image, and the second grayscale is higher than the first grayscale.

According to an exemplary embodiment of the inventive concept, a display apparatus includes a display panel having a pixel including a first transistor having a first non-gate electrode connected to a node receiving a first data signal and an organic light emitting diode (OLED) and a controller configured to receive a second data signal output by a second non-gate electrode of the first transistor. The controller is configured to selectively disable the OLED based on how the second data signal compares to a first reference grayscale and a second reference grayscale that is higher than the first reference grayscale.

In an embodiment, the controller disables the OLED when a grayscale of the second data signal is less than the first reference grayscale during a first time and greater than the second reference grayscale during a second time.

In an embodiment, the pixel further comprises a second transistor connected between a node receiving a voltage configured to reset the OLED and an anode electrode of the OLED, and the controller applies a signal to a gate electrode of the second transistor to disable the OLED.

In a display apparatus according to an exemplary embodiment of the inventive concept, a grayscale of a current image is checked, or grayscales of the current image and a next image are checked. A selective BCB operation in which an initialization voltage is selectively applied to an OLED in each pixel of the display apparatus is performed based on a result of the grayscale checking operation. Accordingly, display defects (e.g., color blurring, etc.) may be prevented, characteristics (e.g., color variation, luminance variation, etc.) of the display apparatus may be improved, and thus the display apparatus may have a relatively improved display quality.

In the display apparatus according to exemplary embodiments, grayscales of a current image and a next image may be checked when a scene change (e.g., in a dynamic image or a moving image displaying several different images, in a scrolling operation, etc.) occurs. The grayscale of the current image may be selectively modified based on a result of the grayscale checking operation. Accordingly, display defects (e.g., color blurring, shadowing, residual image, etc.) may be prevented, and thus the display apparatus may have relatively improved display quality.

BRIEF DESCRIPTION OF THE DRAWINGS

Exemplary embodiments of the inventive concept will be more clearly understood from the following detailed description taken in conjunction with the accompanying drawings.

DETAILED DESCRIPTION OF THE EXEMPLARY EMBODIMENTS

Figure 1:
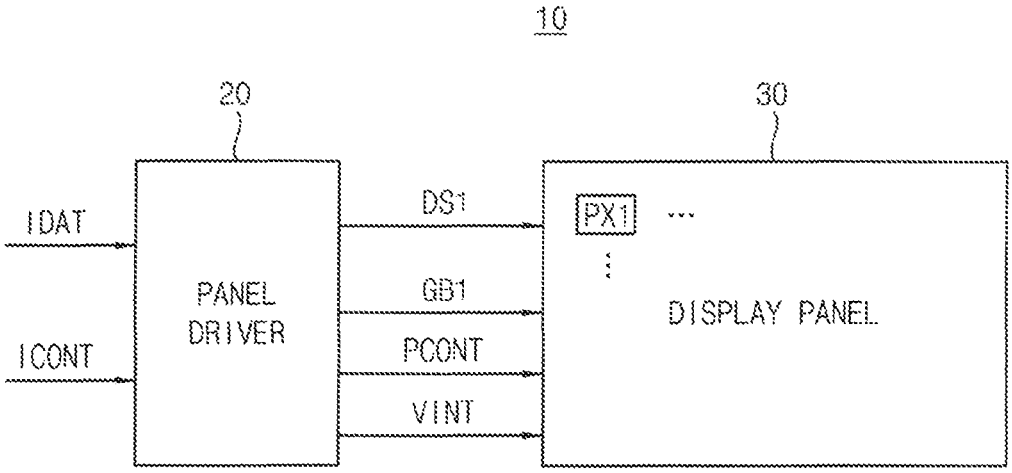
FIG. 1 is a block diagram illustrating a display apparatus according to an exemplary embodiment of the inventive concept.

Hereinafter, exemplary embodiments of the present inventive concept will be explained in detail with reference to the accompanying drawings. This inventive concept may, however, be embodied in many different forms and should not be construed as limited to the embodiments set forth herein. Like reference numerals refer to like elements throughout this application. As used herein, the singular forms, "a," "an" and "the" are intended to include the plural forms as well, unless the context clearly indicates otherwise.

FIG. 1 is a block diagram illustrating a display apparatus according to an exemplary embodiment of the inventive concept.

Referring to FIG. 1, a display apparatus 10 includes a panel driver 20 and a display panel 30.

The panel driver 20 generates a plurality of data signals (e.g., a first data signal DS1) based on input image data IDAT, and performs a grayscale checking operation on an image displayed on the display panel 30 based on the plurality of data signals. The panel driver 20 generates a plurality of initialization control signals (e.g., a first initialization control signal GB1) based on a result of the grayscale checking operation. In an embodiment, the panel driver 20 generates a panel control signal PCONT based on an input control signal ICONT. In an embodiment, the panel driver 20 generates an initialization voltage VINT.

The display panel 30 includes a plurality of pixels (e.g., a first pixel PX1). The display panel 30 operates (e.g., display an image) based on the plurality of data signals, the plurality of initialization control signals, the panel control signal PCONT and the initialization voltage VINT.

In the display apparatus 10 according to an exemplary embodiment of the inventive concept, the display panel 30 display a plurality of frame images, and each of the plurality of pixels may display a plurality of partial images (e.g., pixel images) that are parts of the plurality of frame images. For example, a frame image may correspond to an image that covers the entire display panel, and a pixel image may correspond to an image that is smaller than the frame image. Hereinafter, exemplary embodiments of the inventive concept will be described in more detail based on a single pixel PX1 because operations of the plurality of pixels for displaying images are substantially the same as each other.

As will be described with reference to FIGS. 4 and 9, the first pixel PX1 includes a first organic light emitting diode (OLED) and a first initialization unit (e.g., a circuit or controller) that is connected to the first OLED. The panel driver 20 selectively applies a first voltage to the first OLED based on the result of the grayscale checking operation.

In an exemplary embodiment, the grayscale checking operation determines whether a first image has a relatively low grayscale. For example, the panel driver 20 may generate the first initialization control signal GB1 by comparing a grayscale of the first image with a first reference grayscale. If the grayscale of the first image is lower than the first reference grayscale, the first initialization control signal GB1 may be activated (e.g., set to a first logic level). If the grayscale of the first image is not lower than the first reference grayscale, the first initialization control signal GB1 may be deactivated (e.g., second to a second logic level). The first initialization unit is enabled based on the activated first initialization control signal GB1. In an embodiment, the first voltage is applied to an anode electrode of the first OLED while the first image is displayed. For example, the first voltage may be the initialization voltage VINT.

In an exemplary embodiment, the grayscale checking operation determines whether the first image has a relatively low grayscale and whether a second image has a relatively high grayscale. In an embodiment, the second image is presented subsequent to the first image. For example, the first and second images may be two consecutive images. For example, the panel driver 20 may generate the first initialization control signal GB1 by comparing the grayscale of the first image with the first reference grayscale, and by comparing a grayscale of the second image with a second reference grayscale. If the grayscale of the first image is lower than the first reference grayscale, and if the grayscale of the second image is higher than the second reference grayscale, the first initialization control signal GB1 may be activated. If the grayscale of the first image is not lower than the first reference grayscale, or if the grayscale of the second image is not higher than the second reference grayscale, the first initialization control signal GB1 may be deactivated. In an embodiment, the first initialization unit is enabled based on the activated first initialization control signal GB1. In an embodiment, the first voltage is applied to the anode electrode of the first OLED while the first image is displayed.

For example, each of the first and second images may be a frame image that is displayed on a whole of the display panel 30. In another example, each of the first and second images may be a partial image that is displayed on a part (e.g., the first pixel PX1) of the display panel 30.

As described above, the first initialization control signal GB1 is selectively activated based on the result of the grayscale checking operation. When the first initialization control signal GB1 is activated, the first voltage (e.g., the initialization voltage VINT) is applied to the first OLED while the first image is displayed. As a result, a black current, which is a minimum current for displaying a low grayscale image (e.g., a black image), bypasses the first OLED. Such an operation of selectively applying a voltage for controlling a black current flowing through an OLED may be referred to as a black current bypass (BCB) operation.

In the display apparatus 10 according to an exemplary embodiment of the inventive concept, a grayscale of a current image is checked, or grayscales of the current image and a next image are checked. Based on the result of such a grayscale checking operation, the first voltage (e.g., the initialization voltage VINT) is selectively applied to the OLED in each pixel. In other words, the BCB operation is selectively performed based on the result of the grayscale checking operation. Accordingly, display defects (e.g., color blurring, etc.) may be prevented, characteristics (e.g., color variation, luminance variation, etc.) of the display apparatus 10 may be improved, and thus the display apparatus 10 may have a relatively improved display quality.

Figure 2A:
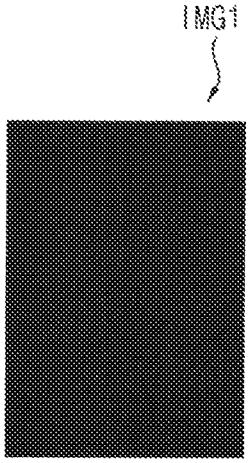
FIGS. 2A and 2B are diagrams for describing an operation of the display apparatus according to an exemplary embodiment of the inventive concept.
Figure 2B:
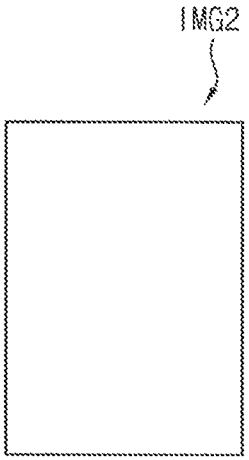

FIGS. 2A and 2B are diagrams for describing an operation of the display apparatus according to exemplary embodiments of the inventive concept. FIGS. 2A and 2B illustrate examples a partial image that is displayed on the first pixel PX1 in FIG. 1.

Referring to FIGS. 1 and 2A, the display apparatus 10 according to an exemplary embodiment of the inventive concept performs the grayscale checking operation and the selective BCB operation in units of a partial image (e.g., in units of a pixel).

The panel driver 20 determines a grayscale of a first image IMG1 of FIG. 2A based on the first data signal DS1 provided to the first pixel PX1.

If the grayscale of the first image IMG1 is lower than the first reference grayscale, the panel driver 20 activates the first initialization control signal GB1. For example, the panel driver 20 may determine the grayscale of the first image IMG1 based on a voltage level of the first data signal DS1.

The first reference grayscale represents a first criterion for determining whether the first image IMG1 is a low grayscale image. For example, if the display panel 30 is capable of displaying 256 different grayscales, which range from about 0 to about 255, the first reference grayscale may have a value of about 3 grayscale. In an exemplary embodiment, the first reference grayscale is two percent of the maximum supported grayscale or between one and two percent of the maximum grayscale.

In the example of FIG. 2A, the grayscale of the first image IMG1 is about or exactly 0 grayscale, which is lower than the first reference grayscale (e.g., about 3 grayscale). In other words, the first image IMG1 is considered to have a low grayscale image (e.g., a black image). In this case, the first initialization control signal GB1 is activated, the first initialization unit is enabled based on the activated first initialization control signal GB1, the initialization voltage VINT is applied to the first OLED in the first pixel PX1 based on the activated first initialization control signal GB1, and thus the first OLED is turned off while the first image IMG1 is displayed. The BCB operation is enabled, and then the first image IMG1 may be displayed with a relatively enhanced quality.

If the grayscale of the first image IMG1 is equal to or higher than the first reference grayscale, the panel driver 20 deactivates the first initialization control signal GB1. In this case, the first initialization unit is disabled based on the deactivated first initialization control signal GB1, and the BCB operation is disabled. In other words, if the grayscale of the first image IMG1 is equal to or higher than the first reference grayscale, the panel driver 20 operates normally without the BCB operation.

Referring to FIGS. 1, 2A and 2B, the panel driver 20 determines the grayscale of the first image IMG1 of FIG. 2A and a grayscale of a second image IMG2 of FIG. 2B based on the first data signal DS1 provided to the first pixel PX1. In an embodiment, the first and second images IMG1 and IMG2 are two consecutive images. Since the first and second images IMG1 and IMG2 are sequentially displayed on the first pixel PX1, a scene change may be visible on the first pixel PX1. For example, a scene change may correspond to a moving image.

If the grayscale of the first image IMG1 is lower than the first reference grayscale, and if the grayscale of the second image IMG2 is higher than the second reference grayscale, the panel driver 20 activates the first initialization control signal GB1.

The second reference grayscale represents a second criterion for determining whether the second image IMG2 is a high grayscale image. For example, if the display panel 30 displays 256 grayscales, which range from about 0 to about 255, the second reference grayscale may have a value of about 252 grayscale. In an exemplary embodiment, the second reference grayscale is ninety eight percent of the maximum supported grayscale or between ninety eight percent and ninety nine percent of the maximum grayscale.

In the example of FIG. 2B, the grayscale of the second image IMG2 may be about 255 grayscale, which is higher than the second reference grayscale (e.g., about 252 grayscale). In other words, the second image IMG2 is considered to have a high grayscale image (e.g., a white image).

In the examples of FIGS. 2A and 2B, the first image IMG1 has a low grayscale image, the second image IMG2 is considered to have a high grayscale image, and thus the first initialization control signal GB1 is activated. The first initialization unit is enabled based on the activated first initialization control signal GB1, the initialization voltage VINT is applied to the first OLED in the first pixel PX1 based on the activated first initialization control signal GB1, and thus the first OLED is turned off while the first image IMG1 is displayed. The BCB operation is enabled, and then the first image IMG1 may be displayed with a relatively enhanced quality.

If the grayscale of the first image IMG1 is equal to or higher than the first reference grayscale, or if the grayscale of the second image IMG2 is equal to or lower than the second reference grayscale, the panel driver 20 deactivates the first initialization control signal GB1. In this case, the first initialization unit is disabled based on the deactivated first initialization control signal GB1, and the BCB operation is disabled.

Although exemplary embodiments are described with reference to FIGS. 2A and 2B based on specific grayscales, exemplary embodiments may be employed to enable the BCB operation for any low grayscale image or for a scene change from any low grayscale image to any high grayscale image.

Figure 3:
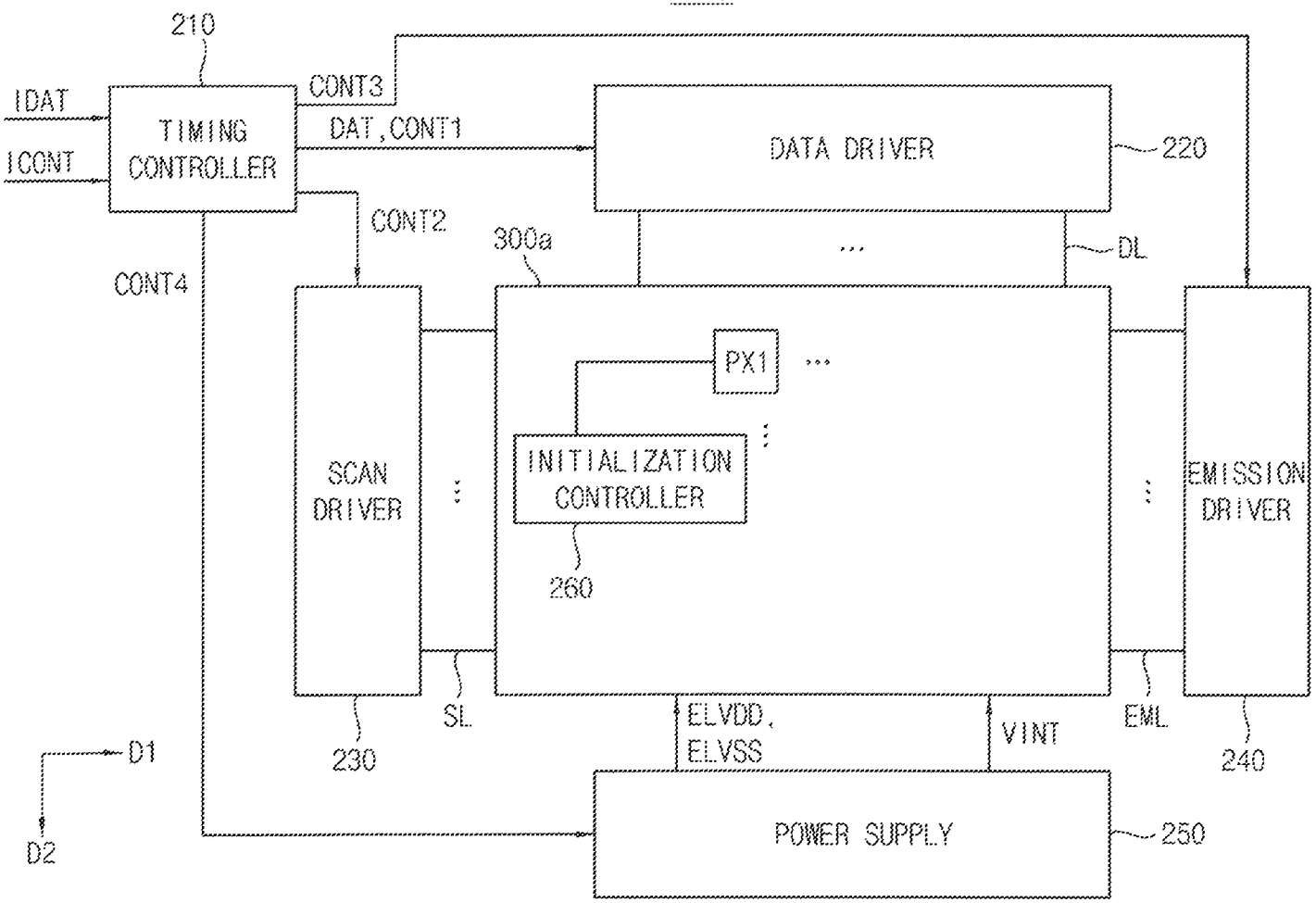
FIG. 3 is a block diagram illustrating an example of the display apparatus of FIG. 1.

FIG. 3 is a block diagram illustrating an example of the display apparatus of FIG. 1.

Referring to FIG. 3, a display apparatus 100*a* includes a panel driver and a display panel 300*a*. The panel driver includes a timing controller 210, a data driver 220, a scan driver 230, an emission driver 240, a power supply 250 and an initialization controller 260.

The display panel 300*a* operates (e.g., display an image) based on output image data DAT. The display panel 300*a* is connected to a plurality of data lines DL, a plurality of scan lines SL and a plurality of emission driving lines EML. The scan lines GL and the emission driving lines EML may extend in a first direction D1, and the data lines DL may extend in a second direction D2 crossing (e.g., substantially perpendicular to) the first direction D1. The display panel 300*a* includes a plurality of pixels. The pixels may be arranged in a matrix form. For example, the plurality of pixels may include the first pixel PX1. Each pixel is electrically connected to a respective one of the data lines DL, a respective one of the scan lines SL and a respective one of the emission driving lines EML.

The timing controller 210 controls operations of the display panel 300*a*, the data driver 220, the scan driver 230, the emission driver 240 and the power supply 250. The timing controller 210 receives input image data IDAT and an input control signal ICONT from an external device (e.g., a host or a graphic processor). The input image data IDAT may include a plurality of pixel data for the plurality of pixels. The input control signal ICONT may include a master clock signal, a data enable signal, a vertical synchronization signal, a horizontal synchronization signal, etc.

The timing controller 210 generates the output image data DAT based on the input image data IDAT. The timing controller 210 generates a first control signal CONT1 for controlling the data driver 220, a second control signal CONT2 for controlling the scan driver 230, a third control signal CONT3 for controlling the emission driver 240 and a fourth control signal CONT4 for controlling the power supply 250 based on the input control signal ICONT. For example, the first control signal CONT1 may include a horizontal start signal, a data clock signal, a data load signal, etc. For example, the second control signal CONT2 may include a vertical start signal, a scan clock signal, etc.

The data driver 220 generates a plurality of data signals (e.g., analog voltages) for driving the data lines DL based on the output image data DAT (e.g., digital data) and the first control signal CONT1. For example, the plurality of data signals may include the first data signal DS1 in FIG. 1. The data driver 220 may sequentially provide the data signals to the data lines DL.

The scan driver 230 generates a plurality of scan signals for driving the scan lines SL based on the second control signal CONT2. The scan driver 230 may sequentially provide the scan signals to the scan lines SL.

The emission driver 240 generates a plurality of emission driving signals for driving the emission driving lines EML based on the third control signal CONT3. The emission driver 240 may sequentially provide the emission driving signals to the emission driving lines EML.

The power supply 250 generates a first power supply voltage ELVDD, a second power supply voltage ELVSS and the initialization voltage VINT based on the fourth control signal CONT4. The power supply 250 may provide the voltages ELVDD, ELVSS and VINT to the display panel 300*a*. In an embodiment, the first power supply voltage ELVDD is higher than the second power supply voltage ELVSS. In an embodiment, the second power supply voltage ELVSS is a ground voltage.

In an exemplary embodiment, the scan signals, the emission driving signals and the power supply voltages ELVDD and ELVSS are included in the panel control signal PCONT in FIG. 1.

In some exemplary embodiments, the data driver 220, the scan driver 230, the emission driver 240 and/or the power supply 250 may be disposed, e.g., directly mounted, on the display panel 300*a*, or may be connected to the display panel 300*a* in a tape carrier package (TCP) type. Alternatively, the data driver 220, the scan driver 230, the emission driver 240 and/or the power supply 250 may be integrated on the display panel 300*a*.

In an exemplary embodiment, at least two of the timing controller 210, the data driver 220, the scan driver 230, the emission driver 240 and the power supply 250 are implemented as one chipset or one integrated circuit.

The initialization controller 260 generates the first initialization control signal (e.g., GB1 in FIG. 1) by checking a grayscale of an image (e.g., the first image IMG1 of FIG. 2A and/or the second image IMG2 of FIG. 2B) based on the first data signal (e.g., DS1 in FIG. 1).

In the example of FIG. 3, the initialization controller 260 is disposed on the display panel 300*a*. For example, the plurality of pixels may be arranged in a display region of the display panel 300*a*, and the initialization controller 260 may be arranged in a peripheral region of the display panel 300*a* that surrounds the display region of the display panel 300*a*.

Although FIG. 3 illustrates an example where the initialization controller 260 is connected to a single pixel PX1, the initialization controller 260 may be connected to more than two pixels according to exemplary embodiments. For example, the initialization controller 260 may be connected to pixels that are arranged in the same row or column as the first pixel PX1. In addition, although not illustrated in FIG. 3, the display apparatus 100*a* may include a plurality of initialization controllers, and the number of pixels connected to each initialization controller may be changed according to exemplary embodiments.

Figure 4:
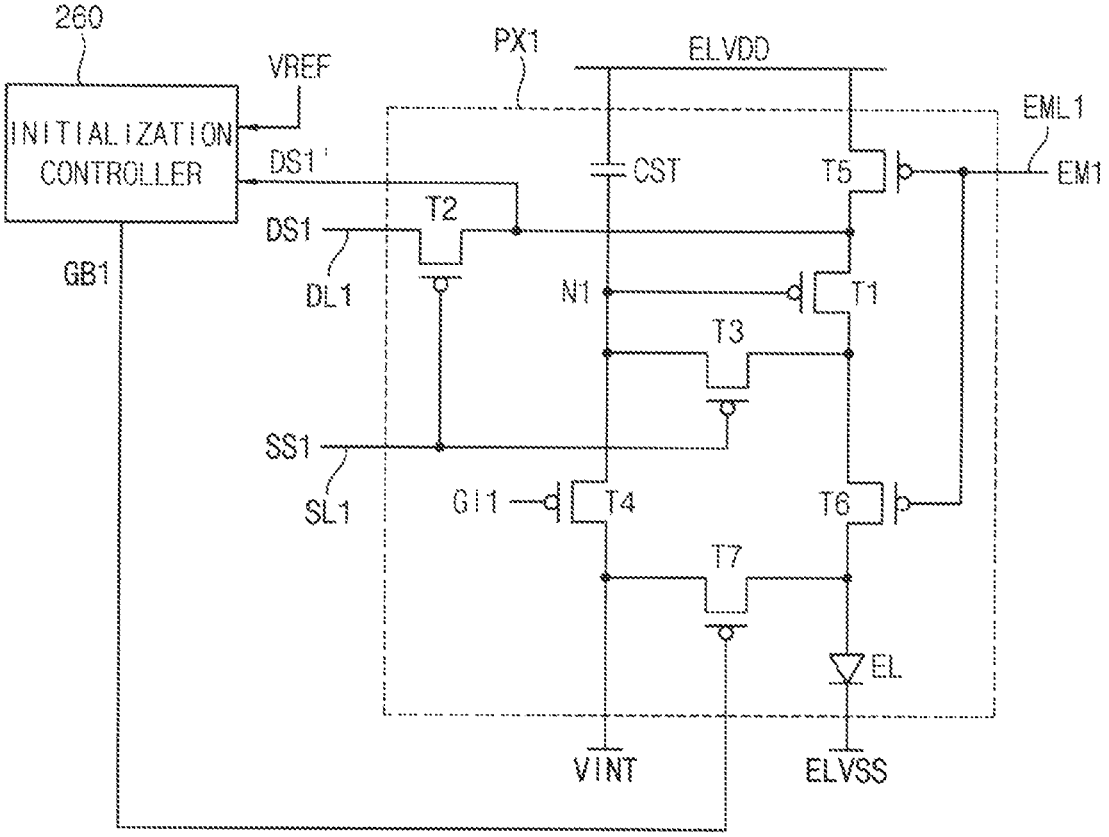
FIG. 4 is a diagram illustrating an example of a first pixel and an initialization controller included in the display apparatus of FIG. 3.

FIG. 4 is a diagram illustrating an example of a first pixel and an initialization controller included in the display apparatus of FIG. 3.

Referring to FIGS. 3 and 4, the first pixel PX1 operates based on the first data signal DS1, a first scan signal SS1, a first emission driving signal EM1, the first power supply voltage ELVDD, the second power supply voltage ELVSS, the initialization voltage VINT and the first initialization control signal GB1. The first data signal DS1 is provided through a first data line DL1, the first scan signal SS1 is provided through a first scan line SL1, and the first emission driving signal EM1 is provided through a first emission driving line EML1.

The first pixel PX1 includes a first OLED EL, a first initialization unit, transistors T1, T2, T3, T4, T5 and T6 and a capacitor CST.

The first transistor T1 has a gate electrode connected to a node N1, and applies a driving current corresponding to the first data signal DS1 to the first OLED EL. The second transistor T2 is connected between the first data line DL1 and a first electrode of the first transistor T1, and has a gate electrode connected to the first scan line SL1. The third transistor T3 is connected between the node N1 and a second electrode of the first transistor T1, and has a gate electrode connected to the first scan line SL1. The fourth transistor T4 is connected between the node N1 and a node receiving the initialization voltage VINT, and has a gate electrode receiving a control signal GI1. For example, the control signal GI1 may correspond to a previous scan signal applied to a previous scan line prior to the first scan line SL1. For example, when SL1 is a second scan line, GI1 may correspond to a first scan signal applied to a first scan line. The fifth transistor T5 is connected between a node providing the first power supply voltage ELVDD and the first electrode of the first transistor T1, and has a gate electrode connected to the first emission driving line EML1. The sixth transistor T6 is connected between the second electrode of the first transistor T1 and an anode electrode of the first OLED EL, and has a gate electrode connected to the first emission driving line EML1. The capacitor CST is connected between the first power supply voltage ELVDD and the node N1.

The first OLED EL is connected between a second electrode of the sixth transistor T6 and a node receiving the second power supply voltage ELVSS. The first initialization unit may include a seventh transistor T7. The seventh transistor T7 is connected between the anode electrode of the first OLED EL and the initialization voltage VINT, and has a gate electrode receiving the first initialization control signal GB1.

In some exemplary embodiments, at least one of the transistors T3, T4, T5 and T6 included in the first pixel PX1 may be omitted. In some exemplary embodiments, an initialization voltage applied to the seventh transistor T7 may be different from an initialization voltage applied to the fourth transistor T4. In some exemplary embodiments, an emission driving signal applied to the sixth transistor T6 may be different from an emission driving signal applied to the fifth transistor T5. For example, the signal line commonly connecting the gate electrodes of the fifth and sixth transistors T5 and T6 may be removed so that the sixth transistor T6 can receive a different emission driving signal.

The initialization controller 260 may generate the first initialization control signal GB1 by checking a grayscale of an image (e.g., the first image IMG1 in FIG. 2A and/or the second image IMG2 in FIG. 2B) based on the first data signal DS1. For example, the initialization controller 260 may compare a signal DS F with a reference signal VREF, and may generate the first initialization control signal GB1 based on a result of the comparison. In an embodiment, the signal DS F is detected from a second electrode of the second transistor T2, and corresponds to the first data signal DS1. The reference signal VREF may correspond to a reference grayscale (e.g., the first reference grayscale and/or the second reference grayscale).

Although FIG. 4 illustrates an example where the initialization controller 260 generates the first initialization control signal GB1 based on the signal DS1' detected from the second electrode of the second transistor T2, the initialization controller may generate the first initialization control signal GB1 based on the first data signal DS1 detected from a first electrode of the second transistor T2 according to exemplary embodiments. For example, the initialization controller 260 may instead be connected to the first electrode of the second transistor T2 to receive DS1, and then compare DS1 with VREF to perform the checking.

Figure 5A:
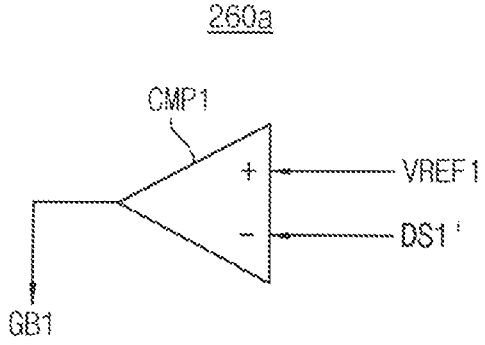
FIGS. 5A and 5B are block diagrams illustrating examples of the initialization controller in FIG. 4.
Figure 5B:
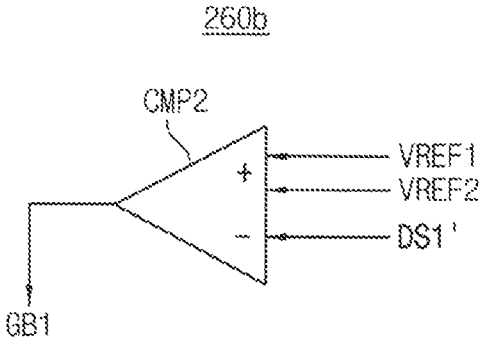

FIGS. 5A and 5B are block diagrams illustrating examples of the initialization controller in FIG. 4.

Referring to FIG. 5A, an initialization controller 260*a* includes a comparator CMP1.

The comparator CMP1 includes a first input terminal receiving the signal DS1' corresponding to the first data signal DS1, a second input terminal receiving a first reference signal VREF1 corresponding to the first reference grayscale, and an output terminal outputting the first initialization control signal GB1.

Referring to FIG. 5B, an initialization controller 260*b* includes a comparator CMP2.

The comparator CMP2 includes a first input terminal receiving the signal DS1' corresponding to the first data signal DS1, a second input terminal receiving a first reference signal VREF1 corresponding to the first reference grayscale, a third input terminal receiving a second reference signal VREF2 corresponding to the second reference grayscale, and an output terminal outputting the first initialization control signal GB1.

In an exemplary embodiment, as illustrated in FIG. 4, if the first pixel PX1 includes p-type metal oxide semiconductor (PMOS) transistors, a voltage level of a data signal for representing a low grayscale is higher than a voltage level of a data signal for representing a high grayscale. In this example, it is determined that the grayscale of the first image IMG1 of FIG. 2A is lower than the first reference grayscale when a voltage level of the first data signal DS1 or the signal DS1' corresponding to the first image IMG1 is higher than a voltage level of the first reference signal VREF1. Further in this example, it is determined that the grayscale of the second image IMG2 of FIG. 2B is higher than the second reference grayscale when a voltage level of the first data signal DS1 or the signal DS1' corresponding to the second image IMG2 is lower than a voltage level of the second reference signal VREF2. The initialization controller 260*a* of FIG. 5A or the initialization controller 260*b* of FIG. 5B selectively activates the first initialization control signal GB1 based on a result of the determination.

In an exemplary embodiment, although not illustrated in FIG. 4, if the first pixel includes n-type metal oxide semiconductor (NMOS) transistors, a voltage level of a data signal for representing a low grayscale is lower than a voltage level of a data signal for representing a high grayscale. In this example, it is determined that the grayscale of the first image IMG1 of FIG. 2A is lower than the first reference grayscale when a voltage level of the first data signal DS1 or the signal DS1' corresponding to the first image IMG1 is lower than a voltage level of the first reference signal VREF1. Further in this example, it is determined that the grayscale of the second image IMG2 of FIG. 2B is higher than the second reference grayscale when a voltage level of the first data signal DS1 or the signal DS1' corresponding to the second image IMG2 is higher than a voltage level of the second reference signal VREF2.

Figure 7:
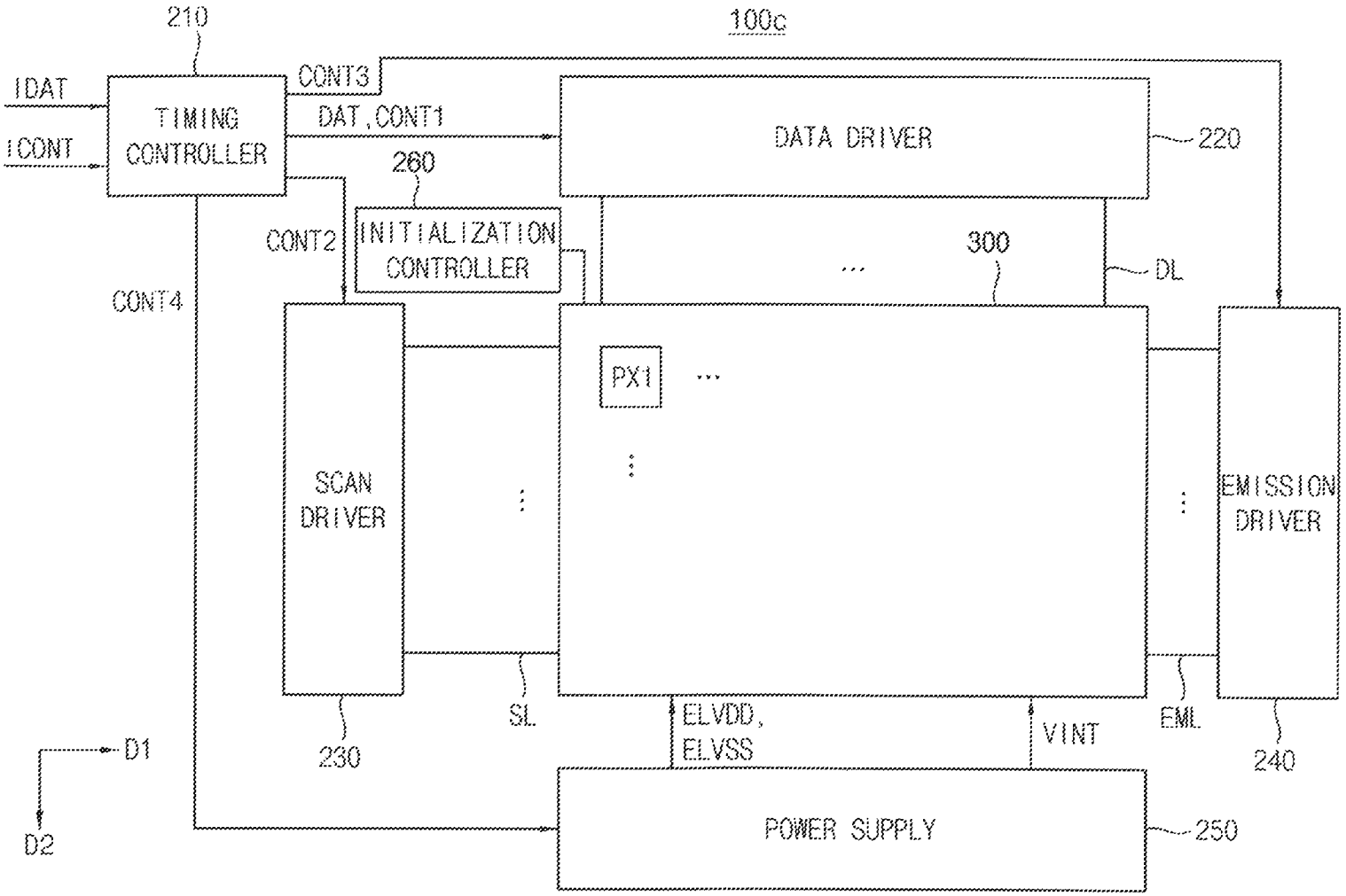
Figure 8:
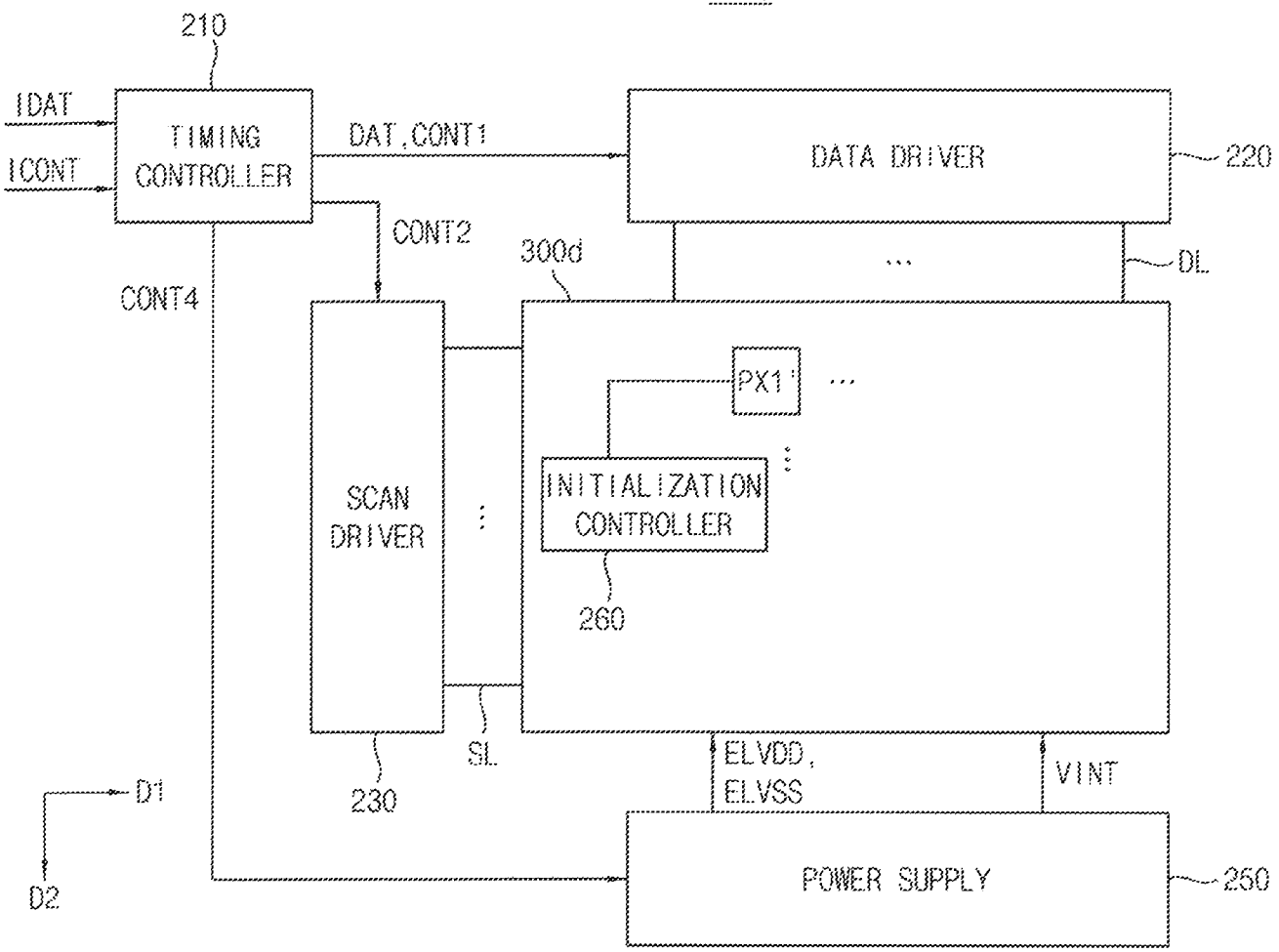

Although not illustrated in FIG. 5A, the initialization controller 260*a* may further include at least one resistor and/or at least one capacitor that are connected to an input terminal of the comparator CMP1 or that are connected between an input terminal and an output terminal of the comparator CMP1. Similarly, the initialization controller 260*b* may further include at least one resistor and/or at least one capacitor FIGS. 6, 7 and 8 are block diagrams illustrating other examples of the display apparatus of FIG. 1.

Figure 6:
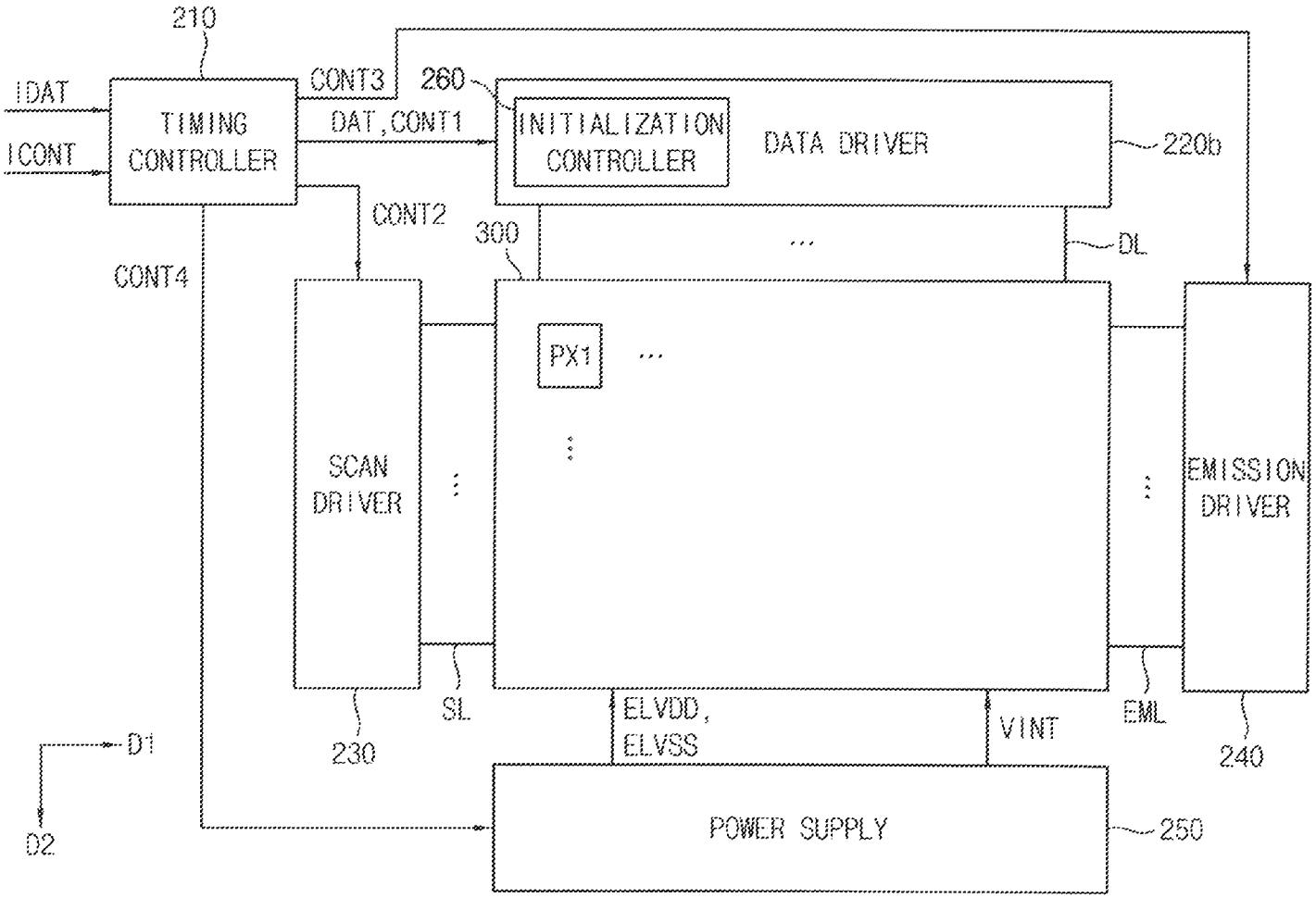
FIGS. 6, 7 and 8 are block diagrams illustrating other examples of the display apparatus of FIG. 1.

Referring to FIG. 6, a display apparatus 100*b* includes a panel driver and a display panel 300. The panel driver includes a timing controller 210, a data driver 220*b*, a scan driver 230, an emission driver 240, a power supply 250 and an initialization controller 260.

The display apparatus 100*b* of FIG. 6 may be substantially the same as the display apparatus 100*a* of FIG. 3, except that an arrangement of the initialization controller 260 is changed in FIG. 6, and configurations of the data driver 220*b* and the display panel 300 are changed in FIG. 6.

In an example of FIG. 6, the initialization controller 260 is disposed within the data driver 220*b*. In this example, the initialization controller 260 generates the first initialization control signal GB1 based on one of the signal DS1' detected from the second electrode of the second transistor T2 in FIG. 4, the first data signal DS1 detected from the first electrode of the second transistor T2 in FIG. 4, and the first data signal DS1 output from the data driver 220*b*.

Referring to FIG. 7, a display apparatus 100*c* includes a panel driver and a display panel 300. The panel driver includes a timing controller 210, a data driver 220, a scan driver 230, an emission driver 240, a power supply 250 and an initialization controller 260.

The display apparatus 100*c* of FIG. 7 may be substantially the same as the display apparatus 100*a* of FIG. 3, except that an arrangement of the initialization controller 260 is changed in FIG. 7, and a configuration of the display panel 300 is changed in FIG. 7.

In an example of FIG. 7, the initialization controller 260 is not disposed on the display panel 300 or within the data driver 220. The initialization controller 260 may be disposed in any region in the display apparatus 100*c* outside the display panel 300 and outside the data driver 220.

Referring to FIG. 8, a display apparatus 100*d* includes a panel driver and a display panel 300*d*. The panel driver includes a timing controller 210, a data driver 220, a scan driver 230, a power supply 250 and an initialization controller 260.

The display apparatus 100*d* of FIG. 8 may be substantially the same as the display apparatus 100*a* of FIG. 3, except that an emission driver (e.g., the emission driver 240 in FIGS. 3, 6 and 7) is omitted in FIG. 8, and a configuration of each pixel (e.g., a first pixel PX1') included in the display panel 300*d* is changed in FIG. 8.

Although FIG. 8 illustrates an example where the initialization controller 260 is disposed on the display panel 300*d*, the initialization controller may be disposed in the data driver 220 as described with reference to FIG. 6, or may be disposed in any other region in the display apparatus 100*d* as described with reference to FIG. 7 according to exemplary embodiments.

Figure 9:
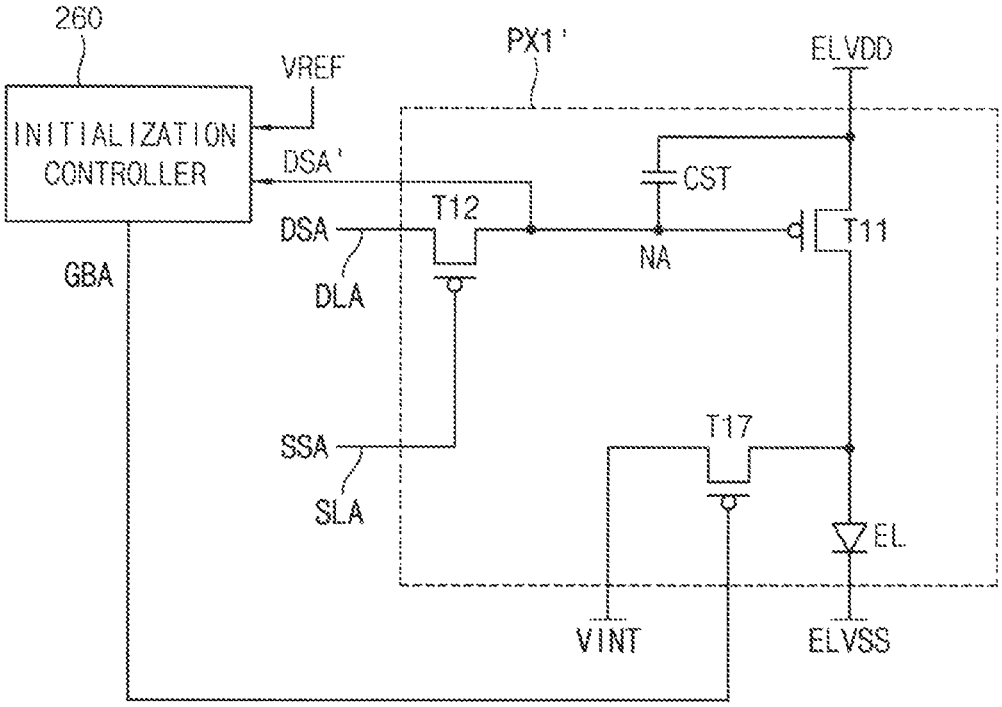
FIG. 9 is a diagram illustrating an example of a first pixel and an initialization controller included in the display apparatus of FIG. 8.

FIG. 9 is a diagram illustrating an example of a first pixel and an initialization controller included in the display apparatus of FIG. 8.

Referring to FIGS. 8 and 9, the first pixel PX1' operates based on a first data signal DSA, a first scan signal SSA, the first power supply voltage ELVDD, the second power supply voltage ELVSS, the initialization voltage VINT and a first initialization control signal GBA. The first data signal DSA is provided through a first data line DLA, and the first scan signal SSA is provided through a first scan line SLA.

The first pixel PX1' includes a first OLED EL, a first initialization unit, transistors T11 and T12 and a capacitor CST.

The first transistor T11 has a gate electrode connected to a node NA, and applies a driving current corresponding to the first data signal DSA to the first OLED EL. The second transistor T12 is connected between the first data line DLA and the node NA, and has a gate electrode connected to the first scan line SLA. The capacitor CST is connected between the first power supply voltage ELVDD and the node NA.

The first OLED EL is connected between a second electrode of the first transistor T11 and a node receiving the second power supply voltage ELVSS. The first initialization unit may include a transistor T17. The transistor T17 is connected between an anode electrode of the first OLED EL and a node receiving the initialization voltage VINT, and has a gate electrode receiving a first initialization control signal GBA.

In some exemplary embodiments, the first pixel PX1' further includes at least one of a third transistor and a fourth transistor that are similar to the third and fourth transistors T3 and T4 in FIG. 4, respectively. For example, the third transistor may be connected between the node NA and the second electrode of the first transistor T11, and may have a gate electrode connected to the first scan line SLA. The fourth transistor may be connected between the node NA and the initialization voltage VINT, and may have a gate electrode receiving a control signal corresponding to a previous scan signal.

The initialization controller 260 may generate the first initialization control signal GBA by checking a grayscale of an image (e.g., the first image IMG1 of FIG. 2A and/or the second image IMG2 of FIG. 2B) based on the first data signal DSA. For example, the initialization controller 260 may compare a signal DSA' corresponding to the first data signal DSA with a reference signal VREF corresponding to a reference grayscale (e.g., the first reference grayscale and/or the second reference grayscale), and may generate the first initialization control signal GBA based on a result of the comparison. For example, the initialization controller 260 may include a comparator as described with reference to FIGS. 5A and 5B.

Figure 10:
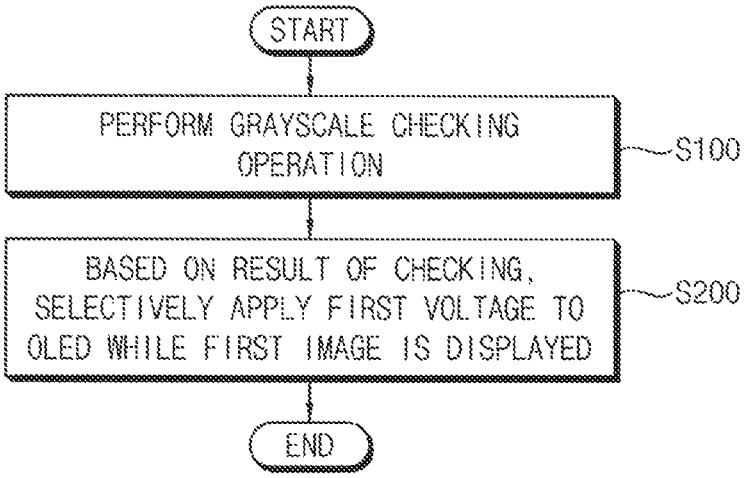
FIG. 10 is a flow chart illustrating a method of operating a display apparatus according to an exemplary embodiment of the inventive concept.

FIG. 10 is a flow chart illustrating a method of operating a display apparatus according to an exemplary embodiment of the inventive concept.

Referring to FIGS. 1, 2A, 2B and 10, in a method of operating the display apparatus 10 according to an exemplary embodiment of the inventive concept, a grayscale checking operation is performed on an image displayed on the display panel 30 (step S100). For example, the grayscale checking operation may determine whether a first image has a relatively low grayscale. In another example, the grayscale checking operation may determine whether the first image has a relatively low grayscale and whether a second image has a relatively high grayscale. The first and second images may be two consecutive images. For example, each of the first and second images may be a frame image or a partial image.

Based on a result of the grayscale checking operation, a first voltage is selectively applied to a first OLED included in the first pixel PX1 while the first image is displayed (step S200). For example, the first voltage may be the initialization voltage VINT, and the initialization voltage VINT may be applied to an anode electrode of the first OLED. When the initialization voltage VINT is applied to the first pixel PX1, the BCB operation for bypassing a black current is enabled.

In the method of operating the display apparatus 10 according to an exemplary embodiment of the inventive concept, a grayscale of a current image is checked, or grayscales of the current image and a next image are checked. Based on the result of such a grayscale checking operation, the initialization voltage VINT is selectively applied to the OLED in each pixel. Accordingly, display defects (e.g., color blurring) may be prevented, characteristics (e.g., color variation, luminance variation, etc.) of the display apparatus 10 may be improved, and thus the display apparatus 10 may have a relatively improved display quality.

Figure 11A:
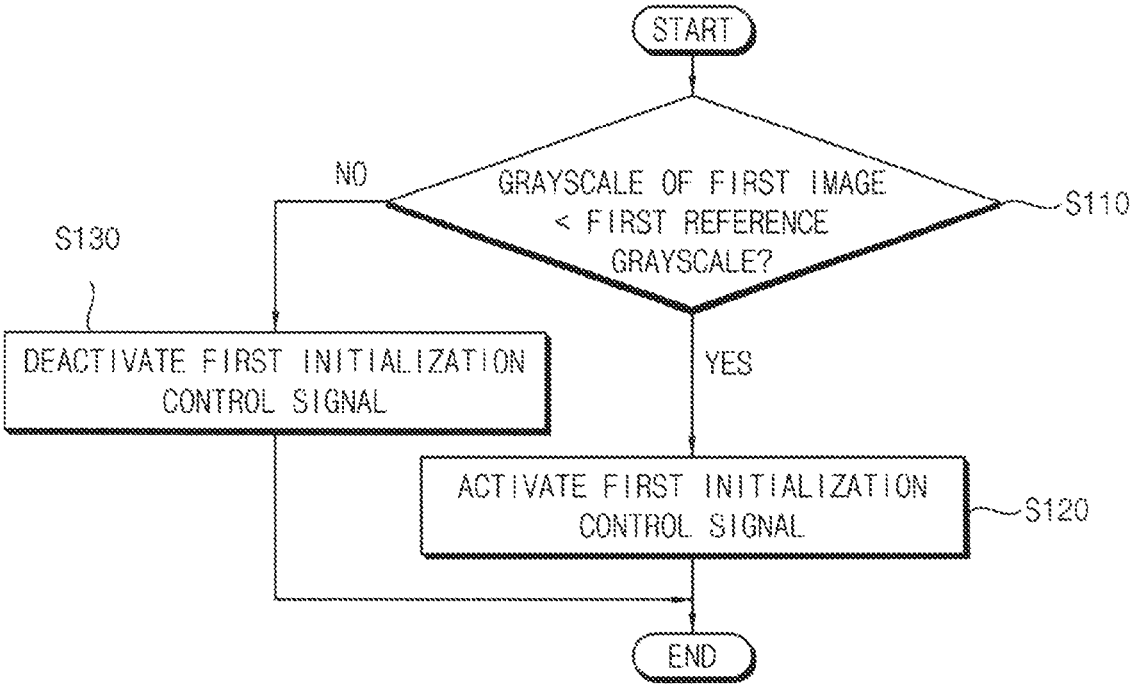
FIGS. 11A and 11B are flow charts illustrating examples of step S100 in FIG. 10.
Figure 11B:
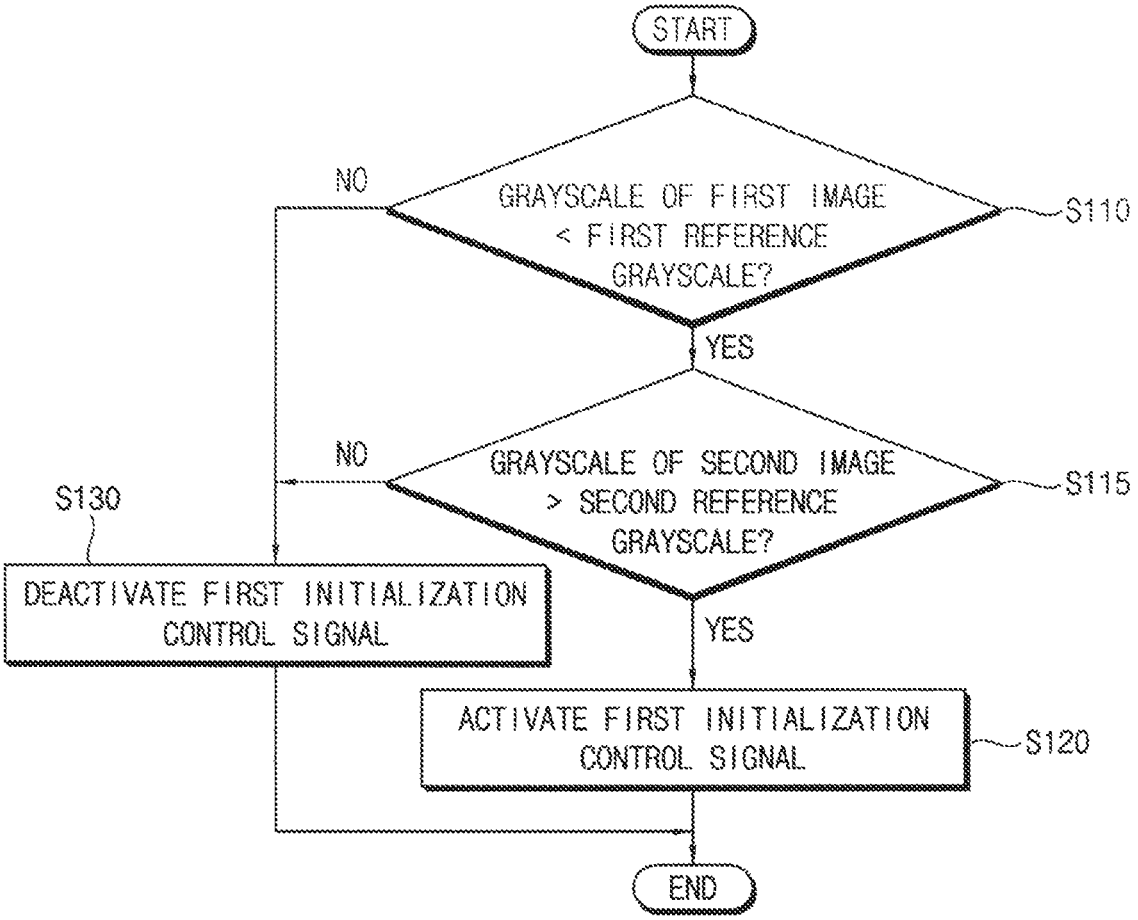

FIGS. 11A and 11B are flow charts illustrating examples of step S100 in FIG. 10.

Referring to FIGS. 1, 2A, 3, 5A, 10 and 11A, in step S100, it is determined whether a grayscale of the first image IMG1 is lower than a first reference grayscale (step S110). For example, the output image data DAT may be generated based on the input image data IDAT, the first data signal DS1 corresponding to the first image IMG1 may be generated based on the output image data DAT, and the first data signal DS1 corresponding to the first image IMG1 may be compared with the first reference signal VREF1 corresponding to the first reference grayscale. The first reference grayscale may represent a first criterion for determining whether the first image IMG1 is a low grayscale image.

If the grayscale of the first image IMG1 is lower than the first reference grayscale (step S110: YES), the first initialization control signal GB1 is activated (step S120). For example, if the first pixel PX1 includes PMOS transistors, it may be determined that the grayscale of the first image IMG1 is lower than the first reference grayscale when a voltage level of the first data signal DS1 corresponding to the first image IMG1 is higher than a voltage level of the first reference signal VREF1.

If the grayscale of the first image IMG1 is equal to or higher than the first reference grayscale (step S110: NO), the first initialization control signal GB1 is deactivated (step S130).

Referring to FIGS. 1, 2A, 2B, 3, 5B, 10 and 11B, in step S100, it is determined whether the grayscale of the first image IMG1 is lower than the first reference grayscale (step S110), and it is determined whether a grayscale of the second image IMG2 is higher than a second reference grayscale (step S115). For example, the output image data DAT may be generated based on the input image data IDAT, the first data signal DS1 corresponding to the first and second images IMG1 and IMG2 may be generated based on the output image data DAT, the first data signal DS1 corresponding to the first image IMG1 may be compared with the first reference signal VREF1 corresponding to the first reference grayscale, and the first data signal DS1 corresponding to the second image IMG2 may be compared with the second reference signal VREF2 corresponding to the second reference grayscale. The second reference grayscale may represent a second criterion for determining whether the second image IMG2 is a high grayscale image.

If the grayscale of the first image IMG1 is lower than the first reference grayscale (step S110: YES), and if the grayscale of the second image IMG2 is higher than the second reference grayscale (step S115: YES), the first initialization control signal GB1 is activated (step S120). For example, if the first pixel PX1 includes PMOS transistors, it may be determined that the grayscale of the first image IMG1 is lower than the first reference grayscale when a voltage level of the first data signal DS1 corresponding to the first image IMG1 is higher than a voltage level of the first reference signal VREF1. In addition, if the first pixel PX1 includes PMOS transistors, it may be determined that the grayscale of the second image IMG2 is higher than the second reference grayscale when a voltage level of the first data signal DS1 corresponding to the second image IMG2 is lower than a voltage level of the second reference signal VREF2.

If the grayscale of the first image IMG1 is equal to or higher than the first reference grayscale (step S110: NO), or if the grayscale of the second image IMG2 is equal to or higher than the second reference grayscale (step S115: NO), the first initialization control signal GB1 is deactivated (step S130).

Figure 12:
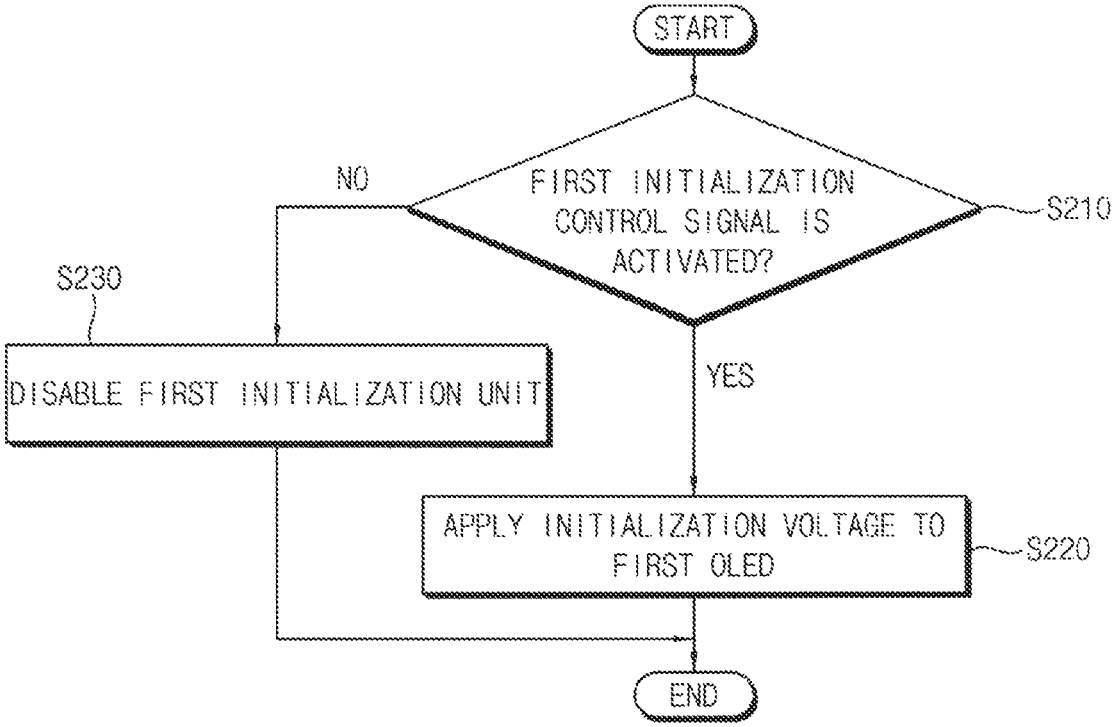
FIG. 12 is a flow chart illustrating an example of step S200 in FIG. 10.

FIG. 12 is a flow chart illustrating an example of step S200 in FIG. 10.

Referring to FIGS. 1, 10 and 12, in step S200, if the first initialization control signal GB1 is activated (step S210: YES), the first initialization unit is enabled based on the activated first initialization control signal GB1, and then the initialization voltage VINT is applied to the first OLED in the first pixel PX1 while the first image IMG1 is displayed (step S220). Thus, the first OLED is turned off while the first image IMG1 is displayed, the BCB operation is enabled for the first pixel PX1, and the first image IMG1 may be displayed with a relatively enhanced quality.

If the first initialization control signal GB1 is deactivated (step S210: NO), the first initialization unit is disabled based on the deactivated first initialization control signal GB1 (step S230), and thus the BCB operation is disabled for the first pixel PX1. For example, when the BCB operation is disabled, the initialization voltage VINT is not applied to the first OLED in the first pixel PX1 while the first image IMG1 is displayed.

Although exemplary embodiments are described based on examples where the grayscale checking operation and the selective BCB operation are performed in units of a partial image (e.g., in units of a pixel), exemplary embodiments may be employed to perform the grayscale checking operation and the selective BCB operation in units of an entire frame image.

Figure 13:
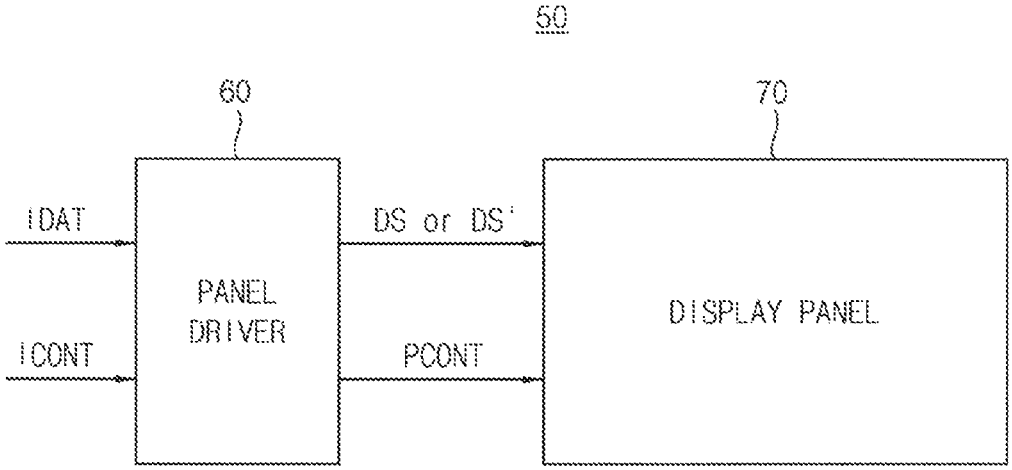
FIG. 13 is a block diagram illustrating a display apparatus according to an exemplary embodiment of the inventive concept.

FIG. 13 is a block diagram illustrating a display apparatus according to an exemplary embodiment of the inventive concept.

Referring to FIG. 13, a display apparatus 50 includes a panel driver 60 and a display panel 70.

The panel driver 60 performs a grayscale checking operation on an image displayed on the display panel 70 based on input image data IDAT, performs a selective modifying operation on the image based on a result of the grayscale checking operation, and generates a plurality of data signals DS or a plurality of modified data signals DS' based on the input image data IDAT and a result of the selective modifying operation. The panel driver 60 may generate a panel control signal PCONT based on an input control signal ICONT.

Figure 19:
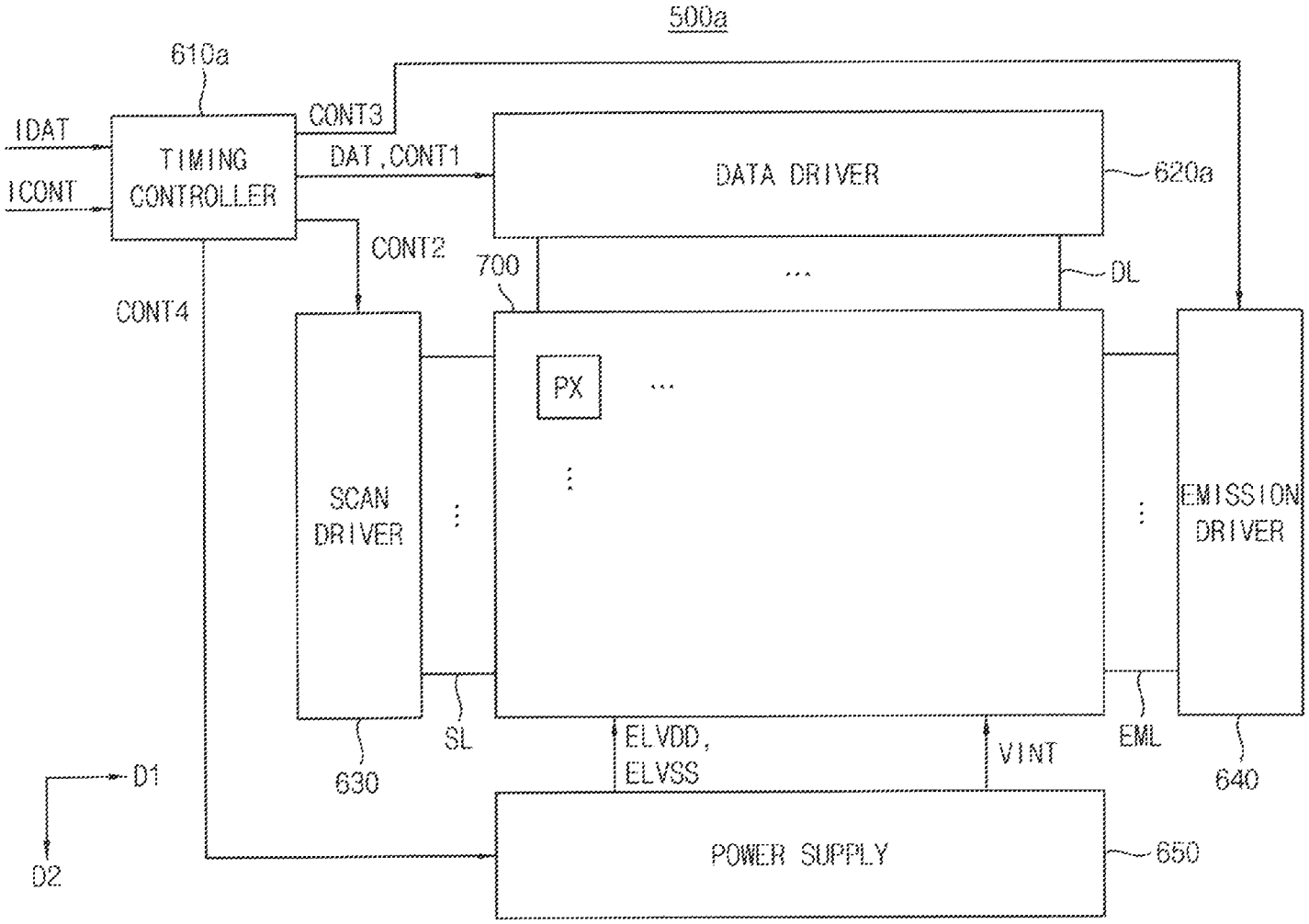
FIG. 19 is a block diagram illustrating an example of the display apparatus of FIG. 13.

The display panel 70 includes a plurality of pixels (e.g., a pixel PX in FIG. 19). The display panel 70 operates (e.g., display an image) based on the data signals DS or the modified data signals DS' and the panel control signal PCONT.

In the display apparatus 50 according to an exemplary embodiment of the inventive concept, the display panel 70 displays a plurality of frame images. Hereinafter, exemplary embodiments of the inventive concept will be described in detail based on the frame images.

The grayscale checking operation may determine whether a first image has a relatively low grayscale and whether a second image has a relatively high grayscale. The second image may be presented subsequent to the first image, and the first and second images may be two consecutive images. The selective modifying operation may represent an operation of modifying a grayscale of the first image only when a predetermined condition occurs.

The display panel 70 may sequentially display the first image and the second image based on the data signals DS, or may sequentially display the modified first image and the second image based on the modified data signals DS'. For example, the modified first image may have a modified grayscale that is different from an original grayscale of the first image.

In the display apparatus 50 according to an exemplary embodiment of the inventive concept, grayscales of a current image and a next image are checked when a scene change (e.g., in a dynamic image or a moving image displaying several different images, in a scrolling operation, etc.) occurs. Based on the result of such a grayscale checking operation, the grayscale of the current image is selectively modified. Accordingly, display defects (e.g., color blurring, shadowing, residual image, etc.) may be prevented, and thus the display apparatus 50 may have a relatively improved display quality.

Figure 14A:
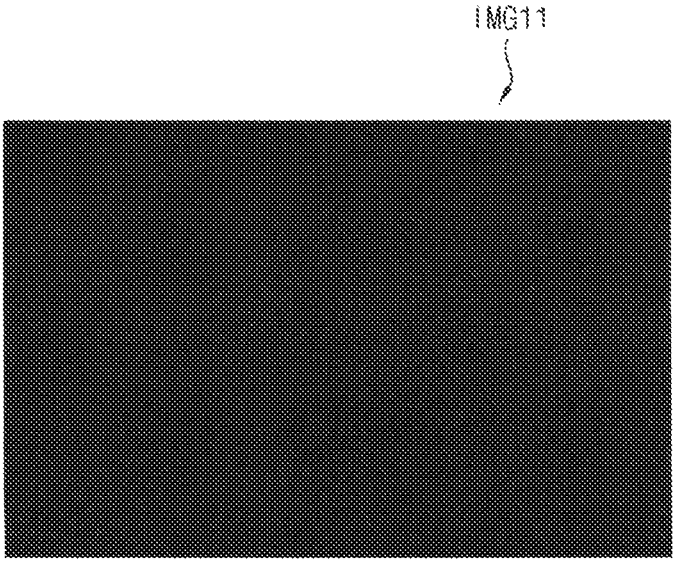
FIGS. 14A, 14B and 14C are diagrams for describing an operation of the display apparatus according to exemplary embodiments of the inventive concept.
Figure 14B:
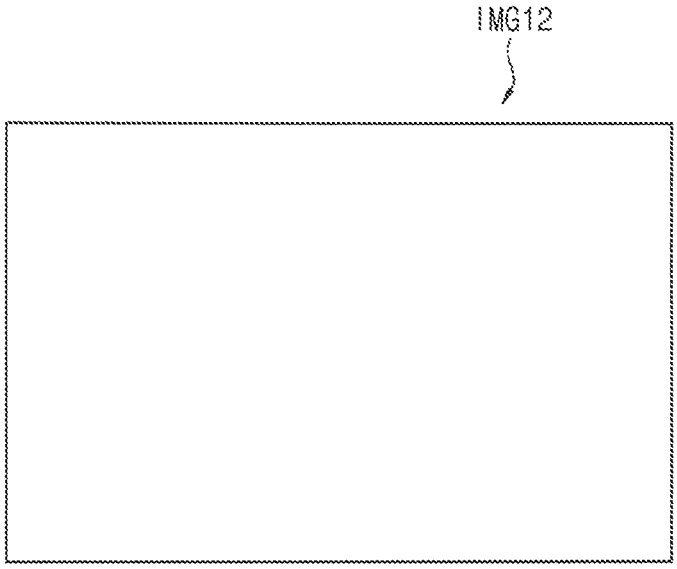
Figure 14C:
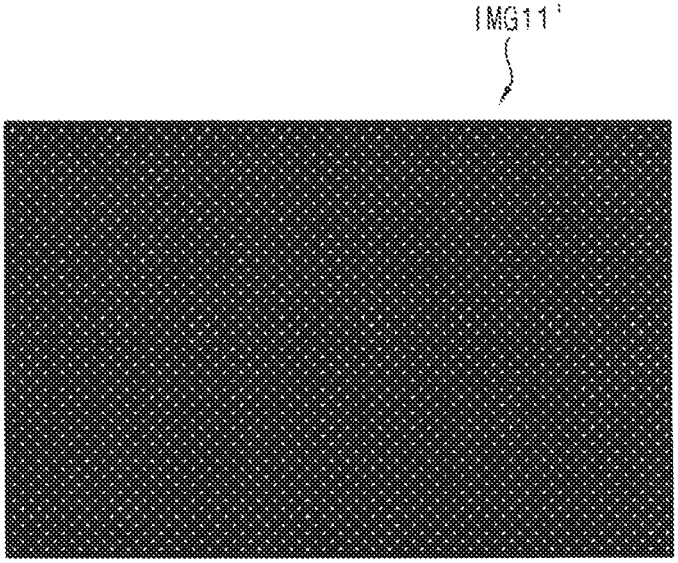

FIGS. 14A, 14B and 14C are diagrams for describing an operation of the display apparatus according to exemplary embodiments. FIGS. 14A, 14B and 14C illustrate examples of a frame image that is displayed on the display panel 70 in FIG. 13.

Referring to FIGS. 13, 14A, 14B and 14C, the display apparatus 50 according to an exemplary embodiment performs the grayscale checking operation and the selective modifying operation in units of a frame image and for a whole region of a frame image.

The panel driver 60 determines a grayscale of a first image IMG11 of FIG. 14A and a grayscale of a second image IMG12 of FIG. 14B based on the input image data IDAT.

If the grayscale of the first image IMG11 is lower than a first reference grayscale, and if the grayscale of the second image IMG12 is higher than a second reference grayscale, the panel driver 60 may modify the first image IMG11 such that the display panel 70 displays a modified first image IMG11' of FIG. 14C instead of the first image IMG11. For example, the panel driver 60 may generate the modified first image IMG11' by increasing the grayscale of the first image IMG11.

The first reference grayscale may represent a first criterion for determining whether the first image IMG11 is a low grayscale image. The second reference grayscale may represent a second criterion for determining whether the second image IMG12 is a high grayscale image. For example, if the display panel 70 displays 256 grayscales, which range from about 0 to about 255, the first reference grayscale may have a value of about 3 grayscale, and the second reference grayscale may have a value of about 252 grayscale. In an exemplary embodiment, the first reference grayscale has a value of about two percent or one to two percent the maximum supported grayscale and the second reference has a value of about ninety eight percent or ninety eight to ninety nine percent the maximum supported grayscale.

In the example of FIG. 14A, the first image IMG11 has about a 0 grayscale, which is lower than the first reference grayscale (e.g., about 3 grayscale). In the example of FIG. 14B, the second image IMG12 has about a 255 grayscale, which is higher than the second reference grayscale (e.g., about 252 grayscale). In other words, the first image IMG11 may be a low grayscale image (e.g., a black image), and the second image IMG12 may be a high grayscale image (e.g., a white image). In the example of FIG. 14C, the modified first image IMG11' has a first grayscale that is higher than the grayscale of the first image IMG11.

In an exemplary embodiment, the first grayscale is substantially the same as the first reference grayscale. For example, if the first reference grayscale is about 3 grayscale, and if the grayscale of the first image IMG11 is about 0 grayscale, the panel driver 60 modifies the first image IMG11 such that the grayscale of the modified first image IMG11' becomes about 3 grayscale. In another example, if the first reference grayscale is about 3 grayscale, and if the grayscale of the first image IMG11 is about 1 or 2 grayscale, the panel driver 60 modifies the first image IMG11 such that the grayscale of the modified first image IMG11' becomes about 3 grayscale. The modified first image IMG11' may be generated using an adder to add a certain fixed amount to the current value of the first image IMG11.

In an exemplary embodiment, the first grayscale is different from the first reference grayscale. For example, if the first reference grayscale is about 3 grayscale, and the grayscale of the first image IMG11 is about 0 grayscale, the panel driver 60 could modify the first image IMG11 such that the grayscale of the modified first image IMG11' becomes about 5 grayscale.

If the grayscale of the first image IMG11 is equal to or higher than the first reference grayscale, or if the grayscale of the second image IMG12 is equal to or lower than the second reference grayscale, the panel driver 60 does not modify the first image IMG11 and instead maintains the first image IMG11.

In an exemplary embodiment, as will be described with reference to FIGS. 16A and 16B, one of the first image IMG11 and the modified first image IMG11', and the second image IMG12 may be two consecutive images that are sequentially displayed on the display panel 70. For example, a selected image among the first image IMG11 and the modified first image IMG11' is displayed on the display panel 70, and the second image IMG12 is then displayed on the display panel 70 immediately after the selected image. In other words, a scene change from the selected image to the second image IMG12 occurs.

Figure 15:
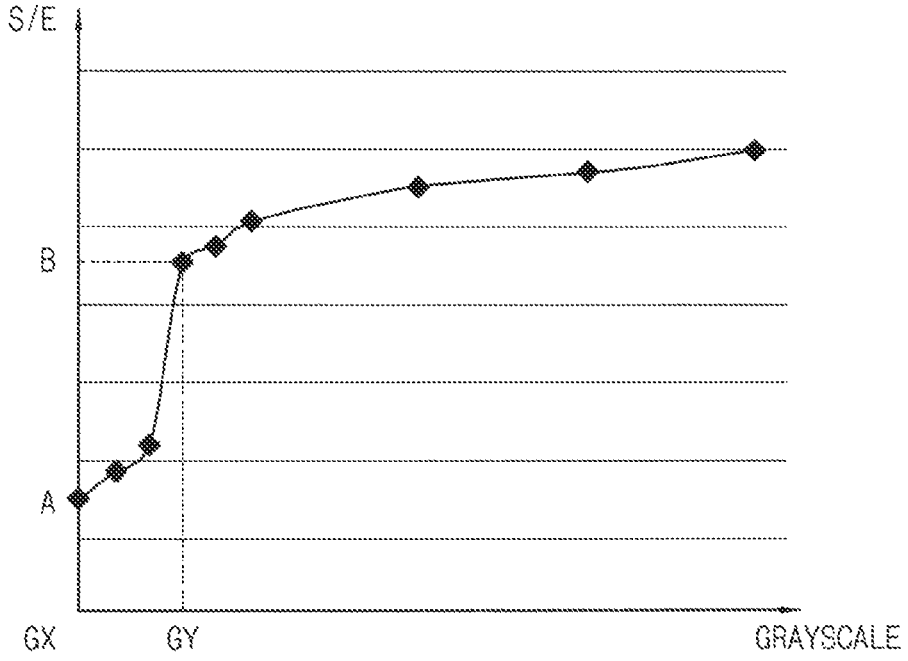
FIGS. 15, 16A and 16B are graphs for describing characteristics of the display apparatus according to exemplary embodiments of the inventive concept.
Figure 16A:
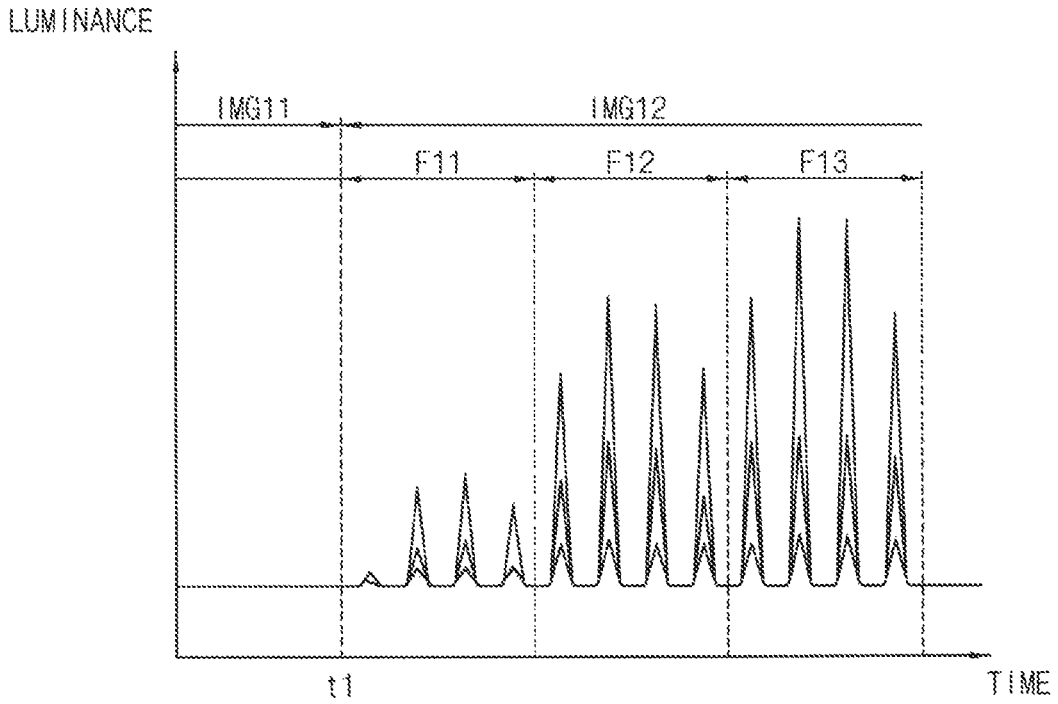
Figure 16B:
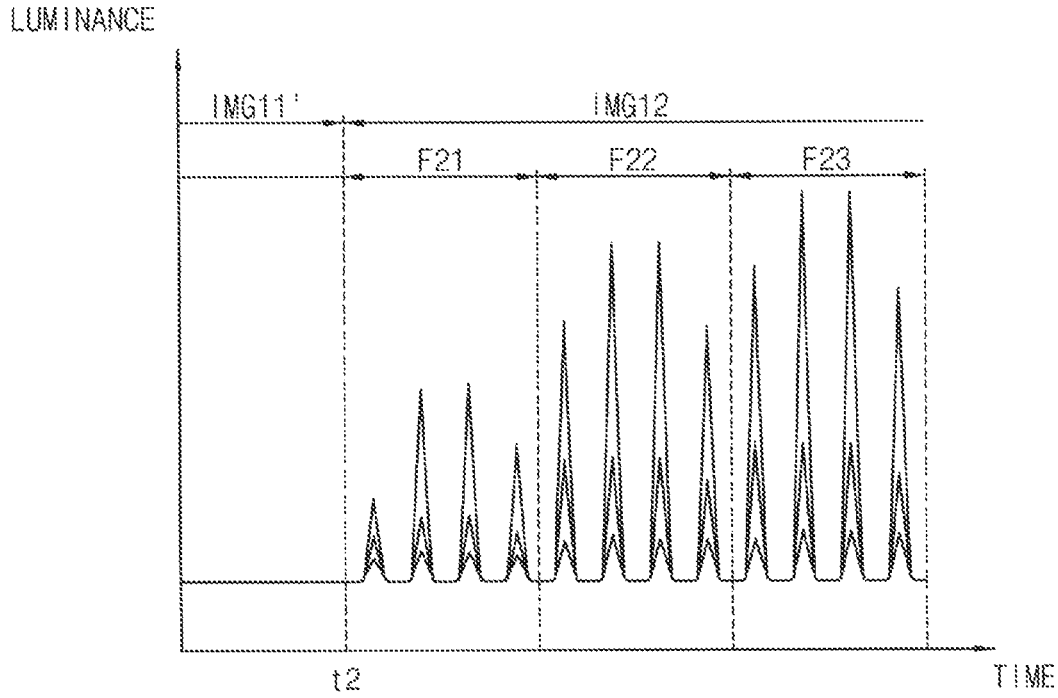

FIGS. 15, 16A and 16B are graphs for describing characteristics of the display apparatus according to exemplary embodiments.

Referring to FIG. 15, a horizontal axis represents a grayscale of a current image when a scene change from the current image to a next image occurs, and a vertical axis represents a step efficiency (S/E) when the scene change occurs. The step efficiency represents an illuminance efficiency according to the scene change. For example, the step efficiency may represent a ratio of a target grayscale of the next image to a real grayscale of the next image immediately after the scene change occurs.

It is assumed that the target grayscale of the next image is about 255 grayscale (e.g., it is assumed that the next image is a white image). If the grayscale of the current image is GX, the step efficiency is "A." If the grayscale of the current image is GY, the step efficiency is "B." For example, GX may be about 0 grayscale, "A" may be about 57.5%, GY may be about 3 grayscale, and "B" may be about 72.6%. In other words, when a scene change from a low grayscale image (e.g., a black image) to a high grayscale image (e.g., a white image) occurs, the step efficiency may sharply increase even if an original grayscale of a low grayscale image slightly increases, and thus the display defects may be prevented.

Referring to FIGS. 16A and 16B, a horizontal axis represents elapsed time, and a vertical axis represents luminance of pixels included in the display panel.

As illustrated in FIG. 16A, a scene change from an original low grayscale image (e.g., the first image IMG11 of FIG. 14A) to a high grayscale image (e.g., the second image IMG12 of FIG. 14B) occurs at time t1. During a first frame F11 among a plurality of frames F11, F12 and F13 for displaying the high grayscale image, the pixels have a relatively low luminance, and thus the display defects may appear due to a lack in the amount of luminance in some pixels. For example, a grayscale of the original low grayscale image may be about 0 grayscale in FIG. 16A.

As illustrated in FIG. 16B, a scene change from a modified low grayscale image (e.g., the modified first image IMG11' of FIG. 14C) to the high grayscale image (e.g., the second image IMG12 of FIG. 14B) occurs at time t2. During a first frame F21 among a plurality of frames F21, F22 and F23 for displaying the high grayscale image, the pixels have a relatively high luminance, and thus the display defects may be prevented. For example, a grayscale of the modified low grayscale image may be about 3 grayscale in FIG. 16B.

FIGS. 17A, 17B, 17C, 18A and 18B are diagrams for describing operations of the display apparatus according to exemplary embodiments. FIGS. 17A, 17B, 17C, 18A and 18B illustrate examples of a frame image that is displayed on the display panel 70 in FIG. 13.

Referring to FIGS. 13, 17A, 17B and 17C, the display apparatus 50 according to an exemplary embodiment of the inventive concept performs the grayscale checking operation and the selective modifying operation in units of a frame image and for a partial region of a frame image.

Figure 17A:
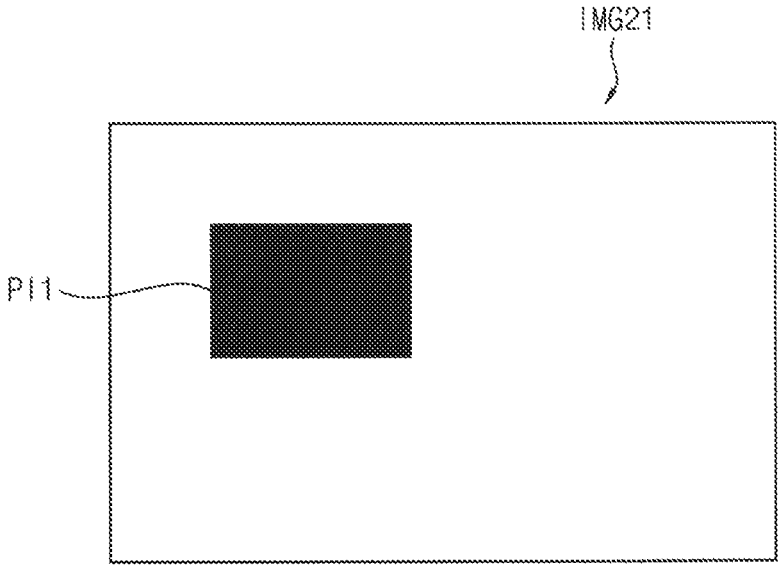
FIGS. 17A, 17B, 17C, 18A and 18B are diagrams for describing operations of the display apparatus according to exemplary embodiments of the inventive concept.
Figure 17B:
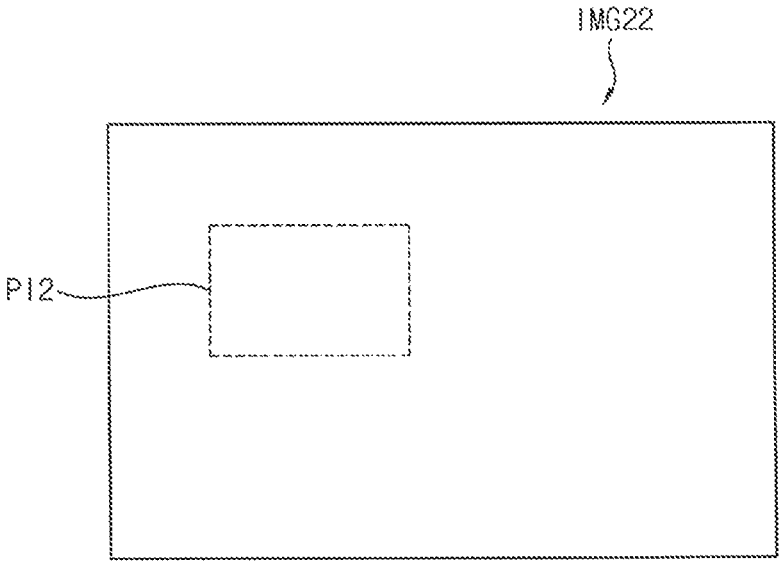

The panel driver 60 determines a grayscale of a first region PI1 in a first image IMG21 of FIG. 17A and a grayscale of a first region PI2 in a second image IMG22 of FIG. 17B based on the input image data IDAT. The first region PI2 in the second image IMG22 corresponds to the first region PI1 in the first image IMG21. For example, the regions PI1 and PI2 are the same region in the images IMG21 and IMG22.

Figure 17C:
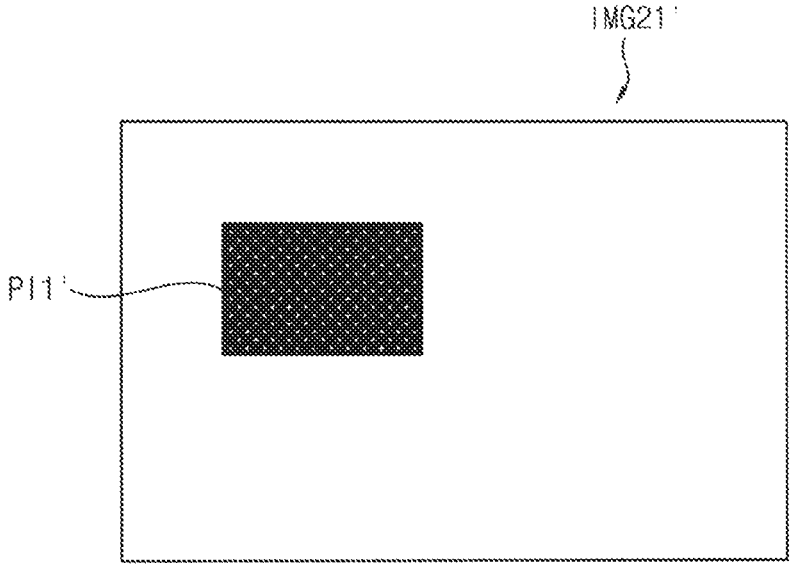

If the grayscale of the first region PI1 in the first image IMG21 is lower than the first reference grayscale (e.g., about 3 grayscale), and if the grayscale of the first region PI2 in the second image IMG22 is higher than the second reference grayscale (e.g., about 252 grayscale), the panel driver 60 modifies the first image IMG21 such that the display panel 70 displays a modified first image IMG21' of FIG. 17C instead of the first image IMG21. For example, the panel driver 60 may generate the modified first image IMG21' by increasing the grayscale of the first region PI1 in the first image IMG21. For example, a grayscale of a first region PI1' in the modified first image IMG21' may be a first grayscale that is higher than the grayscale of the first region PI1 in the first image IMG21. The first region PI1' in the modified first image IMG21' may correspond to the first region PI1 in the first image IMG21.

If the grayscale of the first region PI1 in the first image IMG21 is equal to or higher than the first reference grayscale, or if the grayscale of the first region PI2 in the second image IMG22 is equal to or lower than the second reference grayscale, the panel driver 60 does not modify the first image IMG21 and instead maintains the first image IMG21.

In an exemplary embodiment, an operation of changing (e.g., increasing) the grayscale of the first region PI1 in the first image IMG21 is substantially the same as the operation of changing the grayscale of the first image IMG11 described with reference to FIGS. 14A, 14B and 14C. In an exemplary embodiment, a selected image among the first image IMG21 and the modified first image IMG21', and the second image IMG22 may be two consecutive images that are sequentially displayed on the display panel 70.

Referring to FIGS. 13, 17B, 18A and 18B, the display apparatus 50 according to an exemplary embodiment of the inventive concept performs the grayscale checking operation and the selective modifying operation in units of a frame image and for a partial region of a frame image. Further, an additional modifying operation may be performed for another partial region of the frame image.

Figure 18A:
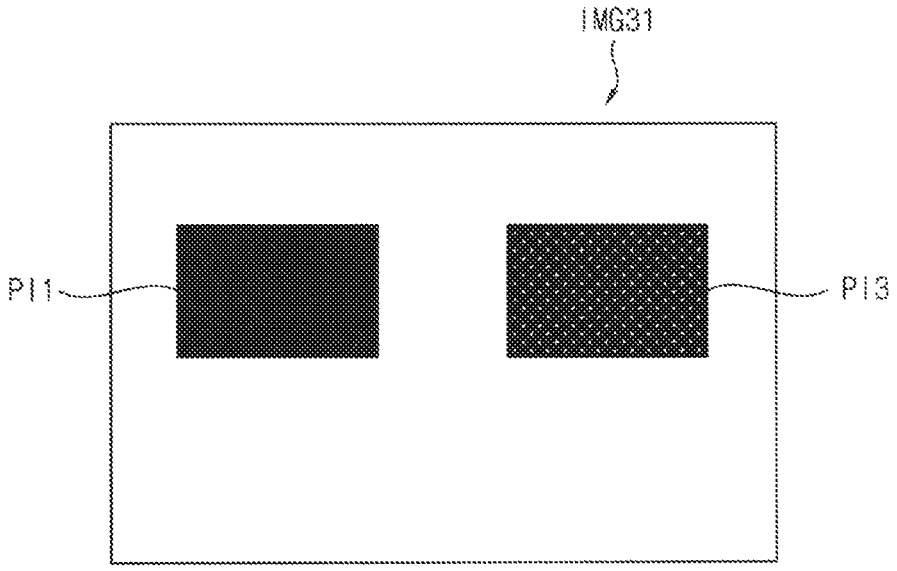

In an exemplary embodiment, the panel driver 60 determines a grayscale of a first region PI1 in a first image IMG31 of FIG. 18A and a grayscale of a first region PI2 in a second image IMG22 of FIG. 17B based on the input image data IDAT. The first region PI2 in the second image IMG22 corresponds to the first region PI1 in the first image IMG31. The panel driver 60 selectively modifies the first image IMG31 based on a result of the determination. In an exemplary embodiment, an operation of changing the grayscale of the first region PI1 in the first image IMG31 is substantially the same as the operation of changing the grayscale of the first region PI1 in the first image IMG21 described with reference to FIGS. 17A, 17B and 17C.

Figure 18B:
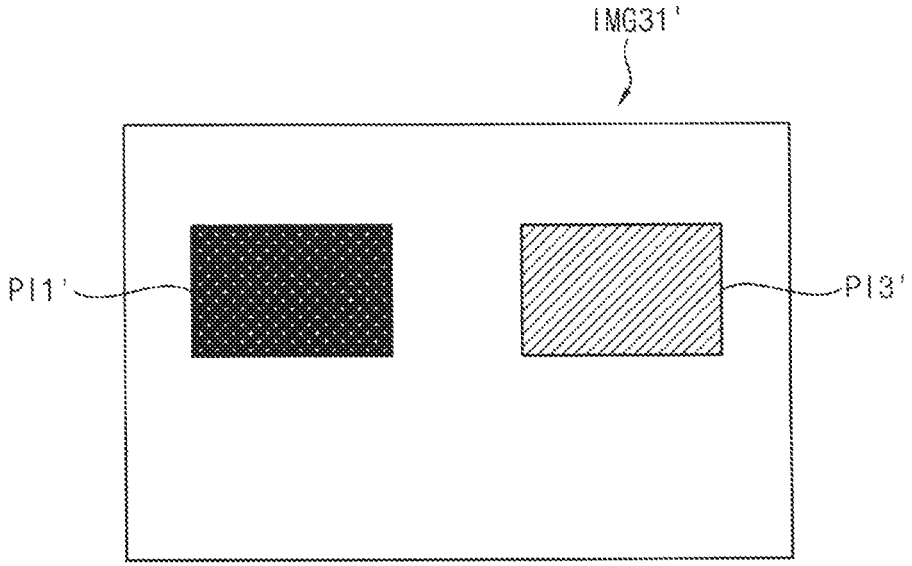

If the grayscale of the first region PI1 in the first image IMG31 is lower than the first reference grayscale, and if the grayscale of the first region PI2 in the second image IMG22 is higher than the second reference grayscale, the panel driver 60 modifies the first image IMG31 such that a grayscale of a first region PI1' in a modified first image IMG31' of FIG. 18B is a first grayscale that is higher than the grayscale of the first region PI1 in the first image IMG31. addition, in an embodiment, the panel driver 60 further determines whether another region having the first grayscale is present in the first image IMG31. If a grayscale of a second region PI3 in the first image IMG31 is the first grayscale, the panel driver 60 generates the modified first image IMG31' by increasing the grayscale of the first region PI1 in the first image IMG31 and by increasing the grayscale of the second region PI3 in the first image IMG31. For example, a second region PI3' in the modified first image IMG31' has a second grayscale that is higher than the first grayscale. In an embodiment, the second regions PI3 and PI3' in the images IMG31 and IMG31' are different from the first regions PI1 and PI1' in the images IMG31 and IMG31'. The second region PI3' in the modified first image IMG31' corresponds to the second region PI3 in the first image IMG31.

In the example of FIG. 18A, the first region PI1 in the first image IMG31 has a grayscale (e.g., about 0 grayscale) lower than the first grayscale (e.g., about 3 grayscale), and the second region PI3 in the first image IMG31 has the first grayscale. In the example of FIG. 18B, the first region PI1' in the modified first image IMG31' has the first grayscale, and the second region PI3' in the modified first image IMG31' has the second grayscale (e.g., about 4 grayscale).

When the modified first image IMG31' is generated by simultaneously or concurrently changing the grayscales of the first and second regions PI1 and PI3 in the first image IMG31, a grayscale difference between the first and second regions PI1 and PI3 in the original image IMG31 may correspond to a grayscale difference between the first and second regions PI1' and PI3' in the modified image IMG31'. Accordingly, the display apparatus 50 may have a relatively improved display quality.

Although exemplary embodiments are described with reference to FIGS. 14A, 14B, 14C, 15, 16A, 16B, 17A, 17B, 17C, 18A and 18B based on specific grayscales, exemplary embodiments may be employed to modify a low grayscale image for a scene change from any low grayscale image to any high grayscale image.

FIG. 19 is a block diagram illustrating an example of the display apparatus of FIG. 13.

Referring to FIG. 19, a display apparatus 500*a* includes a panel driver and a display panel 700. The panel driver includes a timing controller 610*a*, a data driver 620*a*, a scan driver 630, an emission driver 640 and a power supply 650.

The display panel 700 operates (e.g., display an image) based on output image data DAT. The display panel 700 is connected to a plurality of data lines DL, a plurality of scan lines SL and a plurality of emission driving lines EML. The display panel 700 includes a plurality of pixels PX. The pixels PX may be arranged in a matrix form.

As described with reference to FIG. 4, each of the pixels PX may include an OLED, at least one transistor and at least one capacitor. Each of the pixels PX may have one of various configurations according to exemplary embodiments.

In an exemplary embodiment, as illustrated in FIGS. 4 and 9, if each of the pixels PX includes PMOS transistors, a voltage level of a data signal for representing a low grayscale is higher than a voltage level of a data signal for representing a high grayscale. In this example, a voltage level of a data signal (e.g., DS in FIG. 13) corresponding to the first image (e.g., IMG11 of FIG. 14A) is higher than a voltage level of a modified data signal (e.g., DS' in FIG. 13) corresponding to the modified first image (e.g., IMG11' of FIG. 14C)

In an exemplary embodiment, although not illustrated in FIGS. 4 and 9, if each of the pixels PX includes NMOS transistors, a voltage level of a data signal for representing a low grayscale is lower than a voltage level of a data signal for representing a high grayscale. In this example, a voltage level of a data signal (e.g., DS in FIG. 13) corresponding to the first image (e.g., IMG11 of FIG. 14A) is lower than a voltage level of a modified data signal (e.g., DS' in FIG. 13) corresponding to the modified first image (e.g., IMG11' of FIG. 14C).

The timing controller 610*a* controls operations of the display panel 700, the data driver 620*a*, the scan driver 630, the emission driver 640 and the power supply 650. The timing controller 610*a* generates the output image data DAT based on input image data IDAT. The timing controller 610*a* generates a first control signal CONT1, a second control signal CONT2, a third control signal CONT3 and a fourth control signal CONT4 based on an input control signal ICONT.

The data driver 620*a* generates a plurality of data signals (e.g., DS or DS' in FIG. 13) for driving the data lines DL based on the output image data DAT and the first control signal CONT1. The scan driver 630 generates a plurality of scan signals for driving the scan lines SL based on the second control signal CONT2. The emission driver 640 generates a plurality of emission driving signals for driving the emission driving lines EML based on the third control signal CONT3. The power supply 650 generates a first power supply voltage ELVDD, a second power supply voltage ELVSS and an initialization voltage VINT based on the fourth control signal CONT4.

In an exemplary embodiment, the scan signals, the emission driving signals and the voltages ELVDD, ELVSS and VINT are included in the panel control signal PCONT in FIG. 13.

In the example of FIG. 19, the timing controller 610*a* performs both the grayscale checking operation and the selective modifying operation. For example, the timing controller 610*a* may perform the grayscale checking operation based on the input image data IDAT, and may generate the output image data DAT by performing the selective modifying operation based on the input image data IDAT and the result of the grayscale checking operation. The data driver 620*a* may generate the plurality of data signals (e.g., DS or DS' in FIG. 13) based on the output image data DAT.

Figure 20:
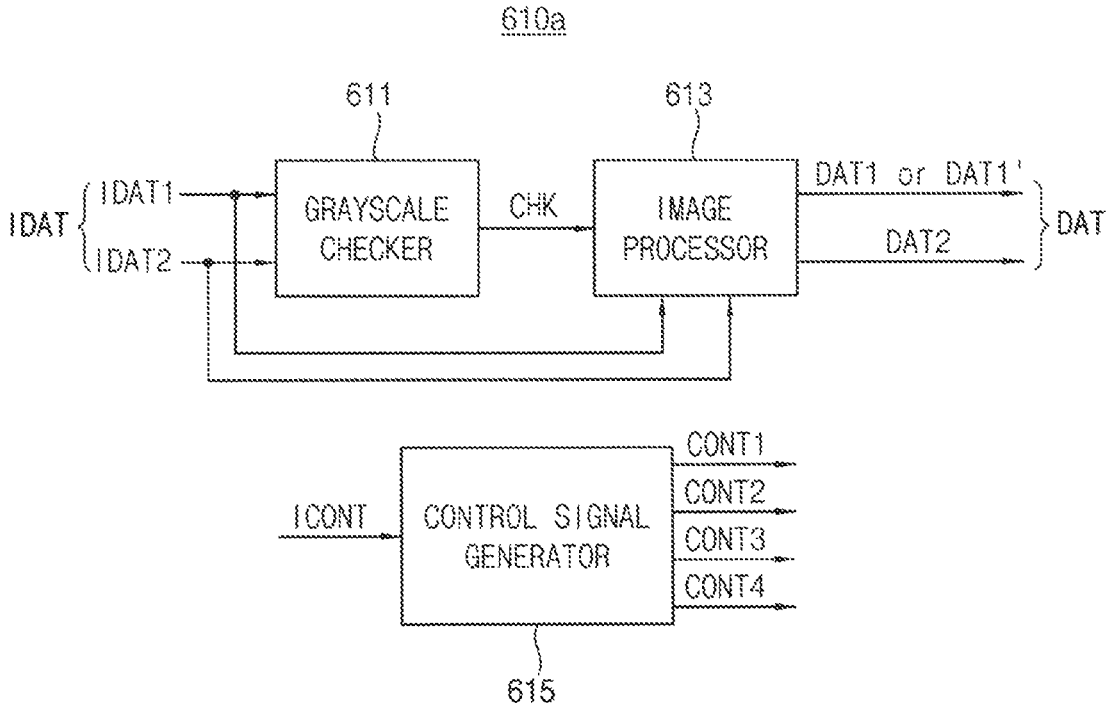
FIG. 20 is a block diagram illustrating an example of a timing controller included in the display apparatus of FIG. 19.

FIG. 20 is a block diagram illustrating an example of a timing controller included in the display apparatus of FIG. 19.

Referring to FIGS. 19 and 20, a timing controller 610*a* includes a grayscale checker 611, an image processor 613 and a control signal generator 615. The timing controller 610*a* is illustrated in FIG. 20 as being divided into three elements for convenience of explanation, however, the timing controller 610*a* need not be physically divided as shown in alternate embodiments.

The grayscale checker 611 performs the grayscale checking operation based on the input image data IDAT. For example, the input image data IDAT may include first input image data IDAT1 corresponding to the first image (e.g., IMG11 of FIG. 14A) and second input image data IDAT2 corresponding to the second image (e.g., IMG12 of FIG. 14B). The grayscale checker 611 outputs a check signal CHK representing the result of the grayscale checking operation. In an embodiment, the grayscale checker 611 is implemented with a processor.

In an exemplary embodiment, if the grayscale of the first image is lower than the first reference grayscale, and if the grayscale of the second image is higher than the second reference grayscale, the check signal CHK has a first logic level (e.g., a high level). In this embodiment, if the grayscale of the first image is equal to or higher than the first reference grayscale, or if the grayscale of the second image is equal to or lower than the second reference grayscale, the check signal CHK has a second logic level (e.g., a low level) different from the first logic level.

The image processor 613 may generate the output image data DAT by performing the selective modifying operation based on the input image data IDAT and the result of the grayscale checking operation (e.g., the check signal CHK). For example, the output image data DAT may include one of first output image data DAT1 corresponding to the first image (e.g., IMG11 of FIG. 14A) and modified first output image data DAT1' corresponding to the modified first image (e.g., IMG11' of FIG. 14C). The output image data DAT may include second output image data DAT2 corresponding to the second image (e.g., IMG12 of FIG. 14B).

In an exemplary embodiment, if the check signal CHK has the first logic level, the image processor 613 generates the modified first output image data DAT1' based on the first input image data IDAT1. In this embodiment, if the check signal CHK has the second logic level, the image processor 613 generates the first output image data DAT1 based on the first input image data IDAT1. The image processor 613 may generate the second output image data DAT2 based on the second input image data IDAT2.

In an exemplary embodiment, the image processor 613 selectively further performs an image quality compensation, a spot compensation, an adaptive color correction (ACC), and/or a dynamic capacitance compensation (DCC) on the input image data IDAT to generate the output image data DAT.

The control signal generator 615 generates the first control signal CONT1, the second control signal CONT2, the third control signal CONT3 and the fourth control signal CONT4 based on the input control signal ICONT.

Although not illustrated in FIGS. 19 and 20, the data driver 620*a* may include a shift register, a data latch, a digital-to-analog converter and an output buffer. The data driver 620*a* may generate the data signals DS based on the first output image data DAT1 and the second output image data DAT2, or may generate the modified data signals DS' based on the modified first output image data DAT1' and the second output image data DAT2.

Figure 21:
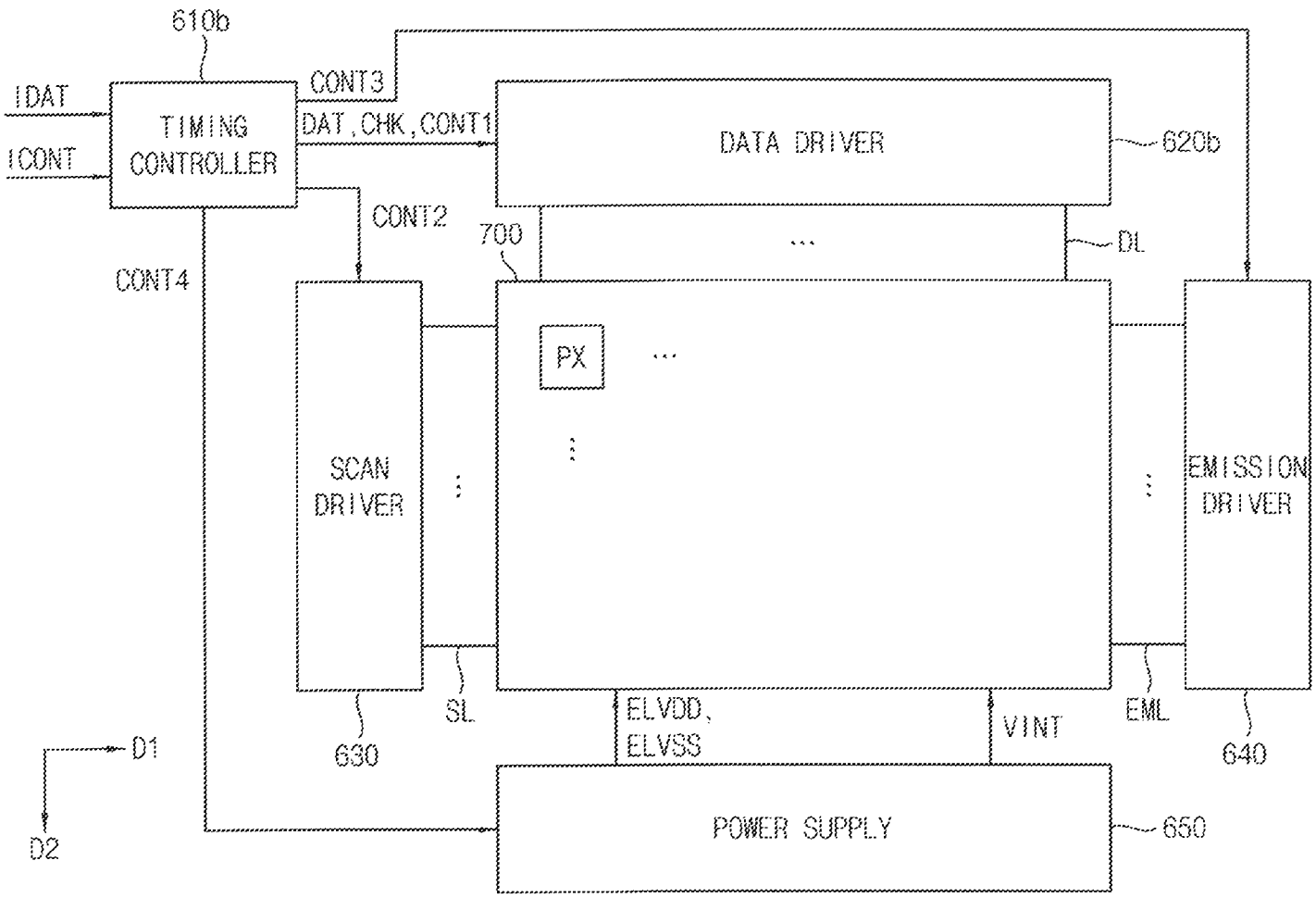
FIG. 21 is a block diagram illustrating another example of the display apparatus of FIG. 13.

FIG. 21 is a block diagram illustrating another example of the display apparatus of FIG. 13.

Referring to FIG. 21, a display apparatus 500*b* includes a panel driver and a display panel 700. The panel driver includes a timing controller 610*b*, a data driver 620*b*, a scan driver 630, an emission driver 640 and a power supply 650.

The display apparatus 500*b* of FIG. 21 may be substantially the same as the display apparatus 500*a* of FIG. 19, except that configurations of the timing controller 610*b* and the data driver 620*b* are changed in FIG. 21.

In the example of FIG. 21, the timing controller 610*b* performs the grayscale checking operation, and the data driver 620*b* performs the selective modifying operation. For example, the timing controller 610*b* performs the grayscale checking operation based on the input image data IDAT, generates a check signal CHK representing the result of the grayscale checking operation, and generates the output image data DAT based on the input image data IDAT. The data driver 620*b* generates the plurality of data signals (e.g., DS or DS' in FIG. 13) by performing the selective modifying operation based on the output image data DAT and the result of the grayscale checking operation (e.g., the check signal CHK).

Figure 22:
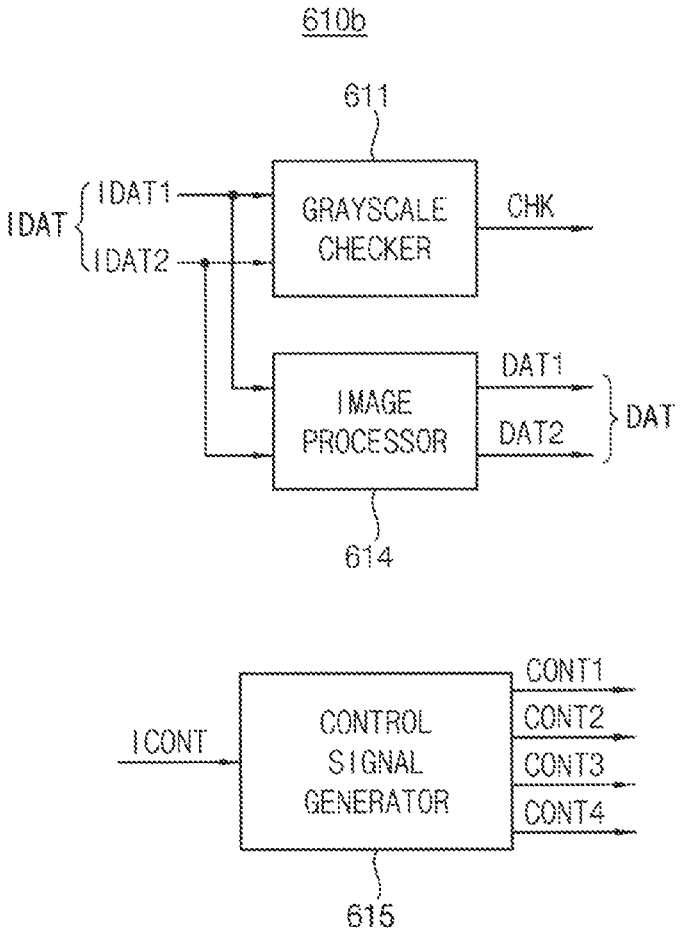
FIG. 22 is a block diagram illustrating an example of a timing controller included in the display apparatus of FIG. 21.

FIG. 22 is a block diagram illustrating an example of a timing controller included in the display apparatus of FIG. 21.

Referring to FIGS. 21 and 22, a timing controller 610*b* includes a grayscale checker 611, an image processor 614 and a control signal generator 615.

The grayscale checker 611 and the control signal generator 615 in FIG. 22 may be substantially the same as the grayscale checker 611 and the control signal generator 615 in FIG. 20, respectively.

The image processor 614 generates the output image data DAT based on the input image data IDAT. For example, the image processor 614 may generate the first output image data DAT1 based on the first input image data IDAT1 corresponding to the first image (e.g., IMG11 of FIG. 14A), and may generate the second output image data DAT2 based on the second input image data IDAT2 corresponding to the second image (e.g., IMG12 of FIG. 14B).

Figure 23:
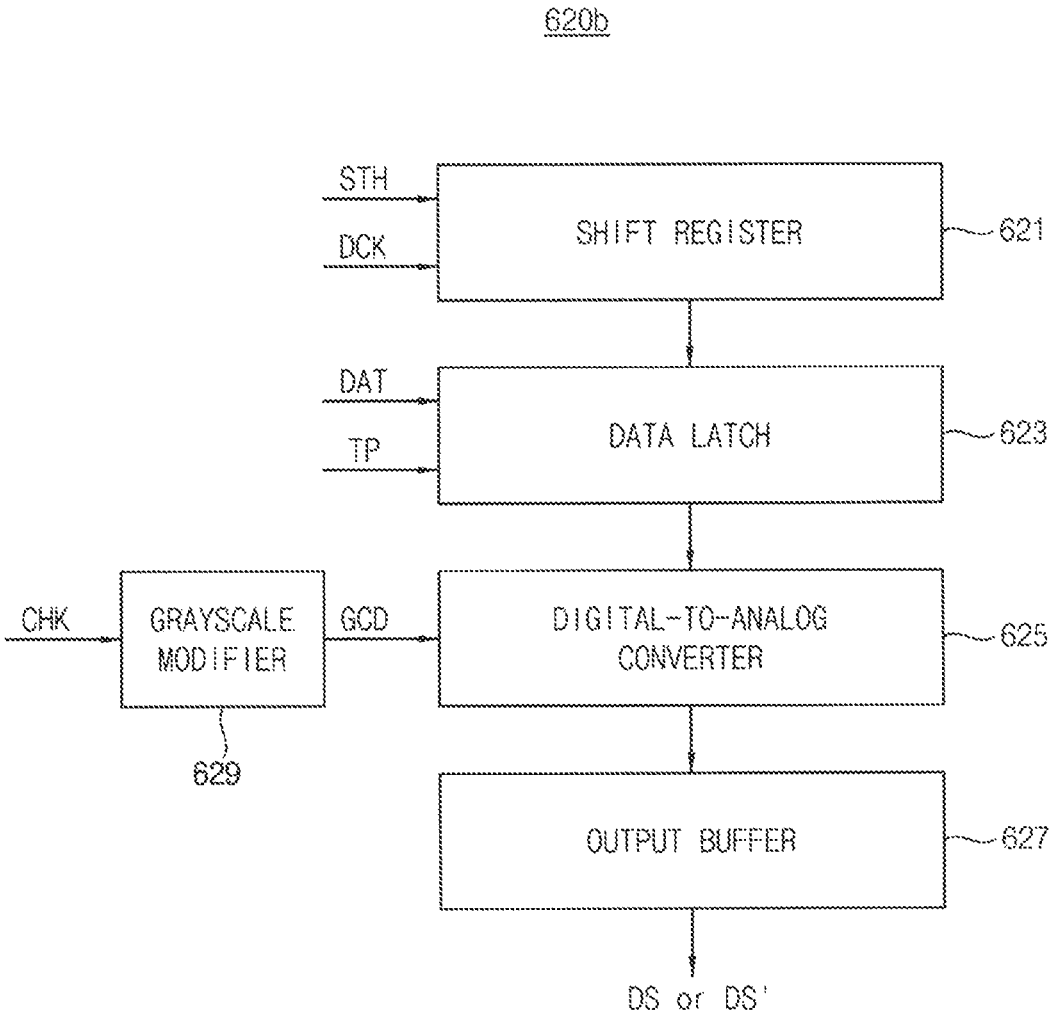
FIG. 23 is a block diagram illustrating an example of a data driver included in the display apparatus of FIG. 21.

FIG. 23 is a block diagram illustrating an example of a data driver included in the display apparatus of FIG. 21.

Referring to FIGS. 21 and 23, a data driver 620*a* includes a shift register 621, a data latch 623, a digital-to-analog converter 625, an output buffer 627 and a grayscale modifier 629.

The shift register 621 generates latch control signals based on a horizontal start signal STH and a data clock signal DCK. The horizontal start signal STH and the data clock signal DCK may be included in the first control signal CONT1 in FIG. 21 that is provided from the timing controller 610*b* in FIG. 21.

The data latch 623 may sequentially store the output image data DAT (e.g., serial data) based on the latch control signals. The data latch 623 may output the output image data DAT (e.g., parallel data) based on a data load signal TP. The data load signal TP may be included in the first control signal CONT1 in FIG. 21.

The grayscale modifier 629 selectively generates grayscale compensation data GCD based on the result of the grayscale checking operation (e.g., the check signal CHK). For example, if the check signal CHK has the first logic level, the grayscale modifier 629 generates the grayscale compensation data GCD such that the display panel 700 in FIG. 21 displays the modified first image (e.g., IMG11' of FIG. 14C). If the check signal CHK has the second logic level, the grayscale modifier 629 does not generate the grayscale compensation data GCD.

The digital-to-analog converter 625 generates the data signals DS or the modified data signals DS' for output to the output buffer 727, and the output buffer 627 outputs the data signals DS or the modified data signals DS'. For example, if the check signal CHK has the first logic level, the modified data signals DS' are generated based on the output image data DAT and the grayscale compensation data GCD such that the display panel 700 in FIG. 21 sequentially displays the modified first image (e.g., IMG11' of FIG. 14C) and the second image (e.g., IMG12 of FIG. 14B). If the check signal CHK has the second logic level, the data signals DS are generated based on the output image data DAT such that the display panel 700 in FIG. 21 sequentially displays the first image (e.g., IMG11 of FIG. 14A) and the second image (e.g., IMG12 of FIG. 14B).

Figure 24:
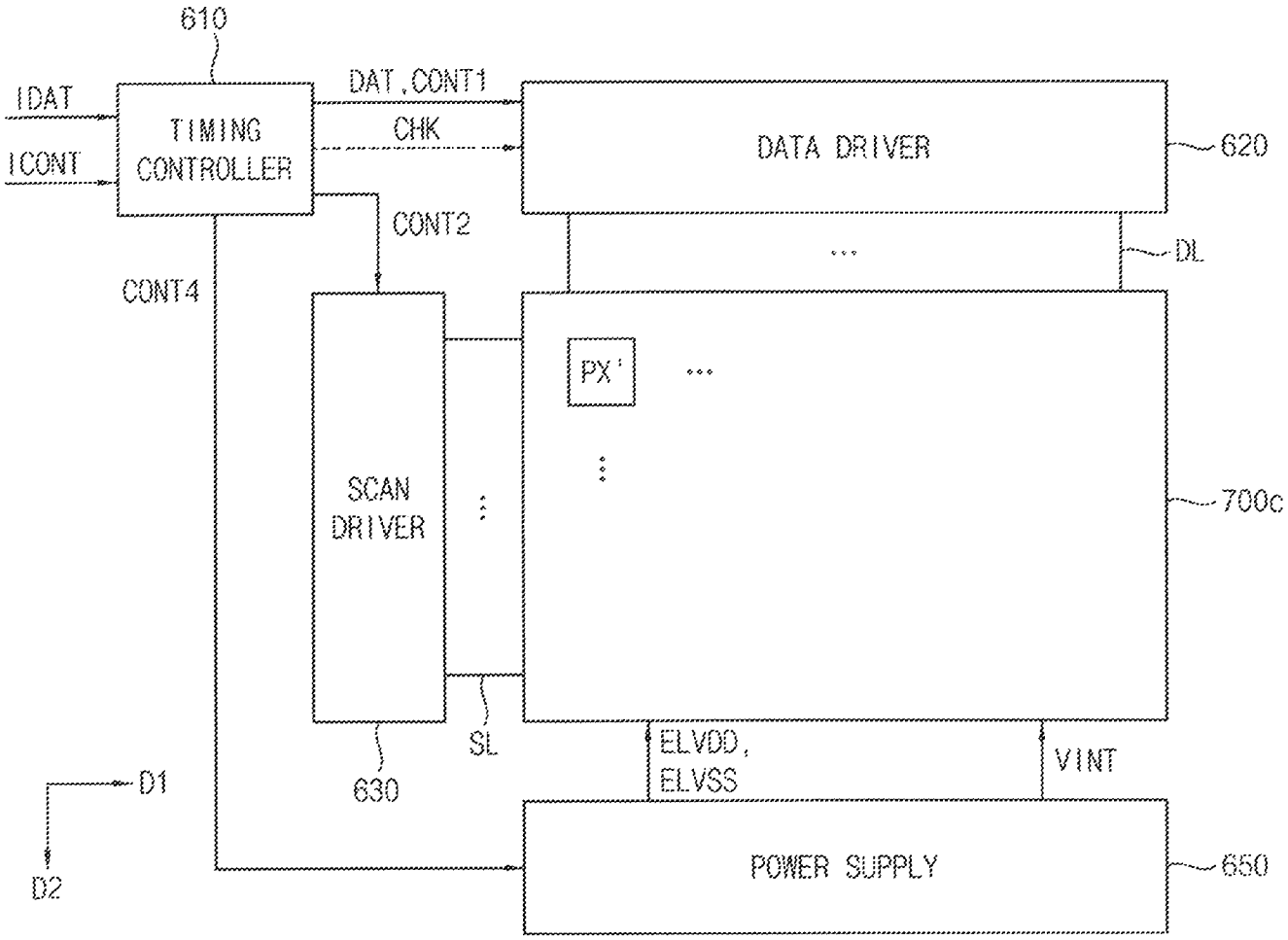
FIG. 24 is a block diagram illustrating an example of the display apparatus of FIG. 13.

FIG. 24 is a block diagram illustrating an example of the display apparatus of FIG. 13.

Referring to FIG. 24, a display apparatus 500*c* includes a panel driver and a display panel 700*c*. The panel driver includes a timing controller 610, a data driver 620, a scan driver 630 and a power supply 650.

The display apparatus 500*c* of FIG. 24 may be substantially the same as the display apparatus 500*a* of FIG. 19 or the display apparatus 500*b* of FIG. 21, except that an emission driver (e.g., the emission driver 640 in FIGS. 19 and 21) is omitted in FIG. 24, and configurations of a plurality of pixels PX' included in the display panel 700*c* are changed in FIG. 24.

As described with reference to FIG. 9, each of the pixels PX' may include an OLED, at least one transistor and at least one capacitor. The number of transistors included in each of the pixels PX' in FIG. 24 may be smaller than the number of transistors included in each of the pixels PX in FIGS. 19 and 21 because the emission driver is omitted in FIG. 24.

The timing controller 610 may be one of the timing controller 610*a* in FIG. 19 and the timing controller 610*b* in FIG. 21. The data driver 620 may be one of the data driver 620*a* in FIG. 19 and the data driver 620*b* in FIG. 21. For example, as described with reference to FIG. 19, the timing controller 610 may perform both the grayscale checking operation and the selective modifying operation. In another example, as described with reference to FIG. 21, the timing controller 610 may perform the grayscale checking operation, and the data driver 620 may perform the selective modifying operation.

The display apparatus 500*a* of FIG. 19, the display apparatus 500*b* of FIG. 21 and the display apparatus 500*c* of FIG. 24 may perform the grayscale checking operation and the selective modifying operation for a whole region of a frame image or for a partial region of a frame image.

Figure 25:
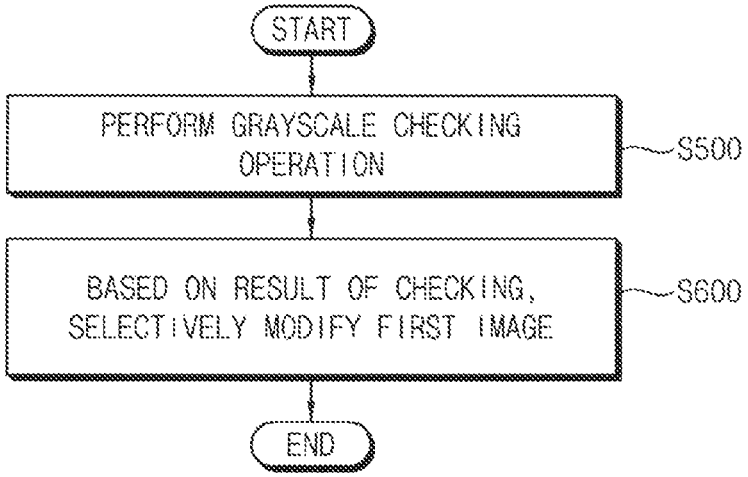
FIG. 25 is a flow chart illustrating a method of operating a display apparatus according to an exemplary embodiment of the inventive concept.

FIG. 25 is a flow chart illustrating a method of operating a display apparatus according to an exemplary embodiment of the inventive concept.

Referring to FIGS. 13, 14A, 14B, 14C and 25, in a method of operating the display apparatus 50 according to an exemplary embodiment of the inventive concept, a grayscale checking operation is performed on an image displayed on the display panel 70 (step S500). For example, the grayscale checking operation may determine whether a first image has a relatively low grayscale and whether a second image has a relatively high grayscale. The first and second images may be two consecutive images. For example, each of the first and second images may be a frame image.

Based on a result of the grayscale checking operation, the first image is selectively modified (step S600). The selective modifying operation may modify a grayscale of the first image only when a predetermined condition occurs. In an embodiment, the display panel 70 sequentially and continuously displays the first image and the second image, or sequentially and continuously displays the modified first image and the second image.

In a method of operating the display apparatus 50 according to an exemplary embodiment of the inventive concept, grayscales of a current image and a next image are checked when a scene change occurs. Based on the result of such a grayscale checking operation, the grayscale of the current image is selectively modified. Accordingly, display defects (e.g., color blurring, shadowing, residual image, etc.) may be prevented, and thus the display apparatus 50 may have a relatively improved display quality.

Figure 26:
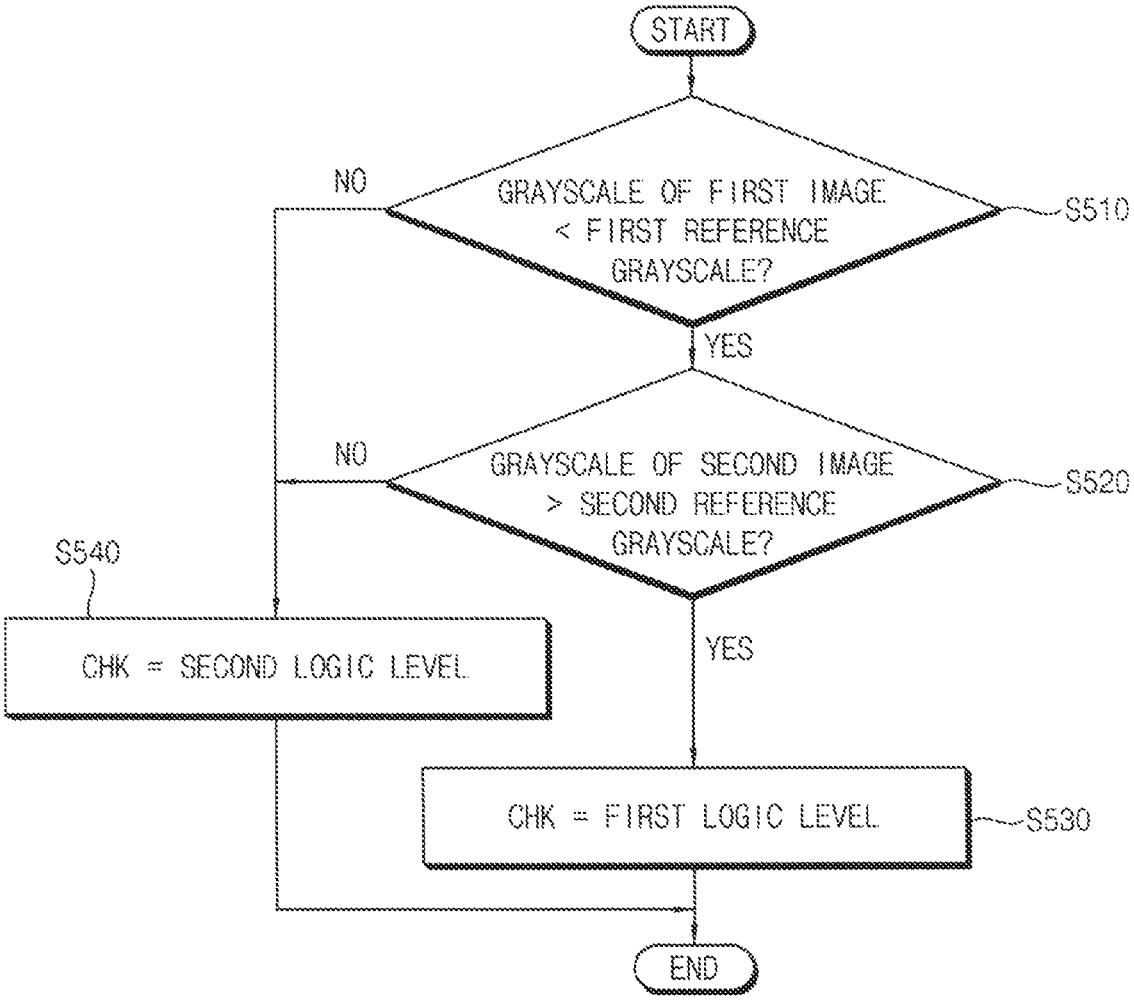
FIG. 26 is a flow chart illustrating an example of step S500 in FIG. 25.

FIG. 26 is a flow chart illustrating an example of step S500 in FIG. 25.

Referring to FIGS. 14A, 14B, 14C, 25 and 26, in step S500, the grayscale checking operation may be performed in units of a frame image and for a whole region of a frame image.

It is determined whether a grayscale of the first image IMG11 is lower than a first reference grayscale (step S510), and it is determined whether a grayscale of the second image IMG12 is higher than a second reference grayscale (step S520). The first reference grayscale may represent a first criterion for determining whether the first image IMG11 is a low grayscale image. The second reference grayscale may represent a second criterion for determining whether the second image IMG2 is a high grayscale image.

If the grayscale of the first image IMG11 is lower than the first reference grayscale (step S510: YES), and if the grayscale of the second image IMG12 is higher than the second reference grayscale (step S520: YES), it is determined that the modifying operation for the first image IMG11 is required, and thus a check signal (e.g., CHK in FIG. 20) having a first logic level is generated (step S530). If the grayscale of the first image IMG11 is equal to or higher than the first reference grayscale (step S510: NO), or if the grayscale of the second image IMG12 is equal to or lower than the second reference grayscale (step S520: NO), it is determined that the modifying operation for the first image IMG11 is not required, and thus the check signal having a second logic level is generated (step S540).

Figure 27:
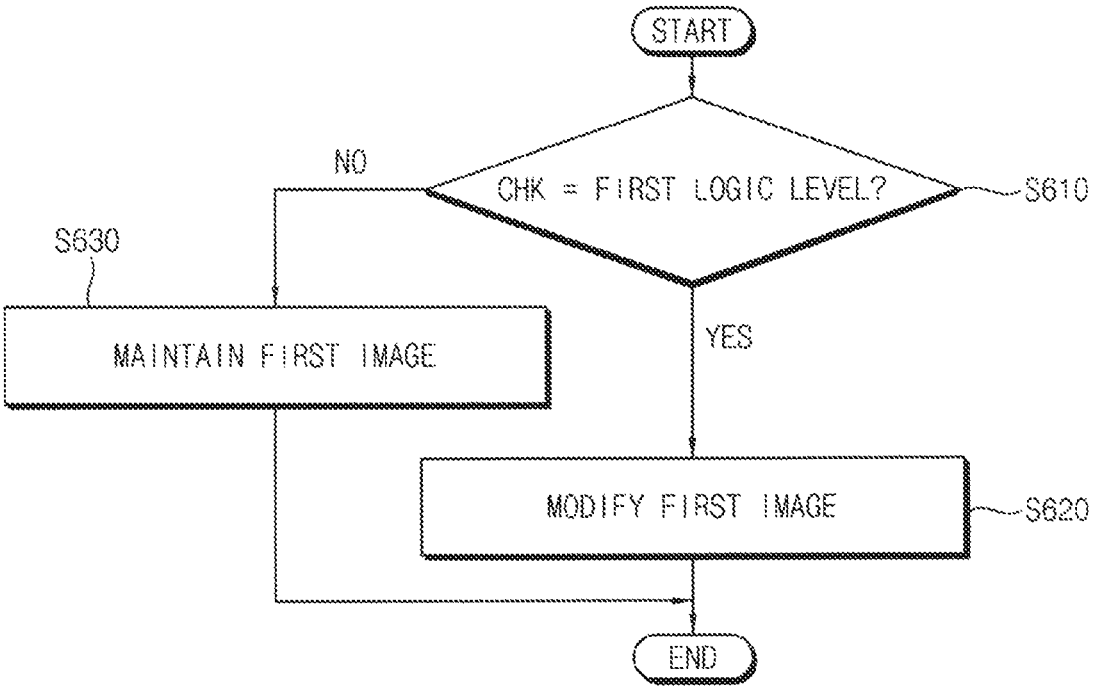
FIG. 27 is a flow chart illustrating an example of step S600 in FIG. 25.

FIG. 27 is a flow chart illustrating an example of step S600 in FIG. 25.

Referring to FIGS. 14A, 14B, 14C, 25 and 27, in step S600, the selective modifying operation may be performed in units of a frame image and for a whole region of a frame image.

If the check signal has the first logic level (step S610: YES), the first image IMG11 is modified (step S620). For example, the modified first image IMG11' may have a first grayscale that is higher than the grayscale of the first image IMG11. In this example, the modified first image IMG11' and the second image IMG12 may be sequentially and continuously displayed.

If the check signal has the first logic level (step S610: NO), the first image IMG11 is not modified and is maintained (step S630). In this example, the first image IMG11 and the second image IMG12 may be sequentially and continuously displayed.

Figure 28:
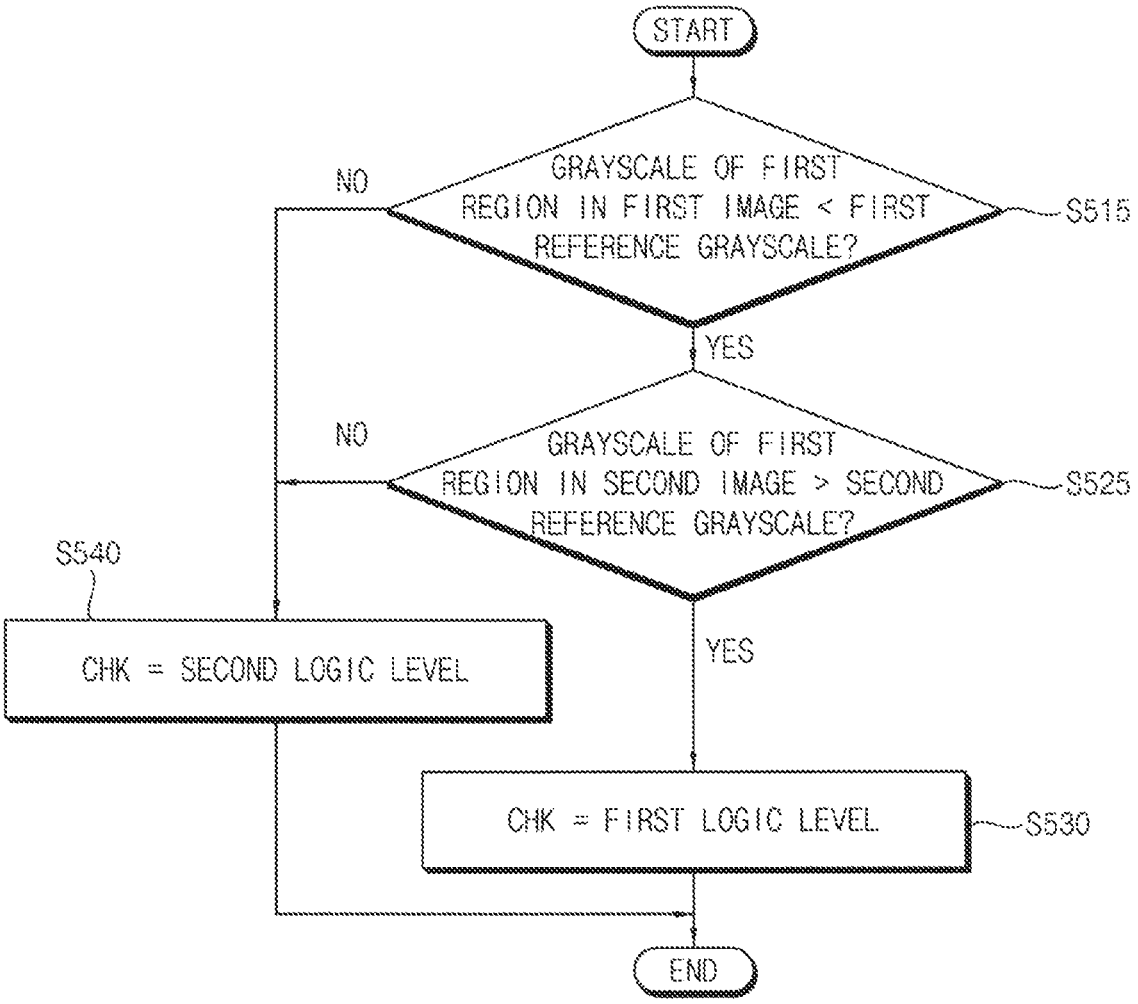
FIG. 28 is a flow chart illustrating another example of step S500 in FIG. 25.

FIG. 28 is a flow chart illustrating another example of step S500 in FIG. 25.

Referring to FIGS. 17A, 17B, 17C, 18A, 18B, 25 and 28, in step S500, the grayscale checking operation may be performed in units of a frame image and for a partial region of a frame image.

It is determined whether a grayscale of the first region PI1 in the first image IMG21 or IMG31 is lower than a first reference grayscale (step S515), and it is determined whether a grayscale of the first region PI2 in the second image IMG22 is higher than a second reference grayscale (step S525).

If the grayscale of the first region PI1 in the first image IMG21 or IMG31 is lower than the first reference grayscale (step S515: YES), and if the grayscale of the first region PI2 in the second image IMG22 is higher than the second reference grayscale (step S525: YES), a check signal (e.g., CHK in FIG. 20) having a first logic level is generated (step S530). If the grayscale of the first region PI1 in the first image IMG21 or IMG31 is equal to or higher than the first reference grayscale (step S515: NO), or if the grayscale of the first region PI2 in the second image IMG22 is equal to or lower than the second reference grayscale (step S525: NO), the check signal having a second logic level is generated (step S540).

Figure 29:
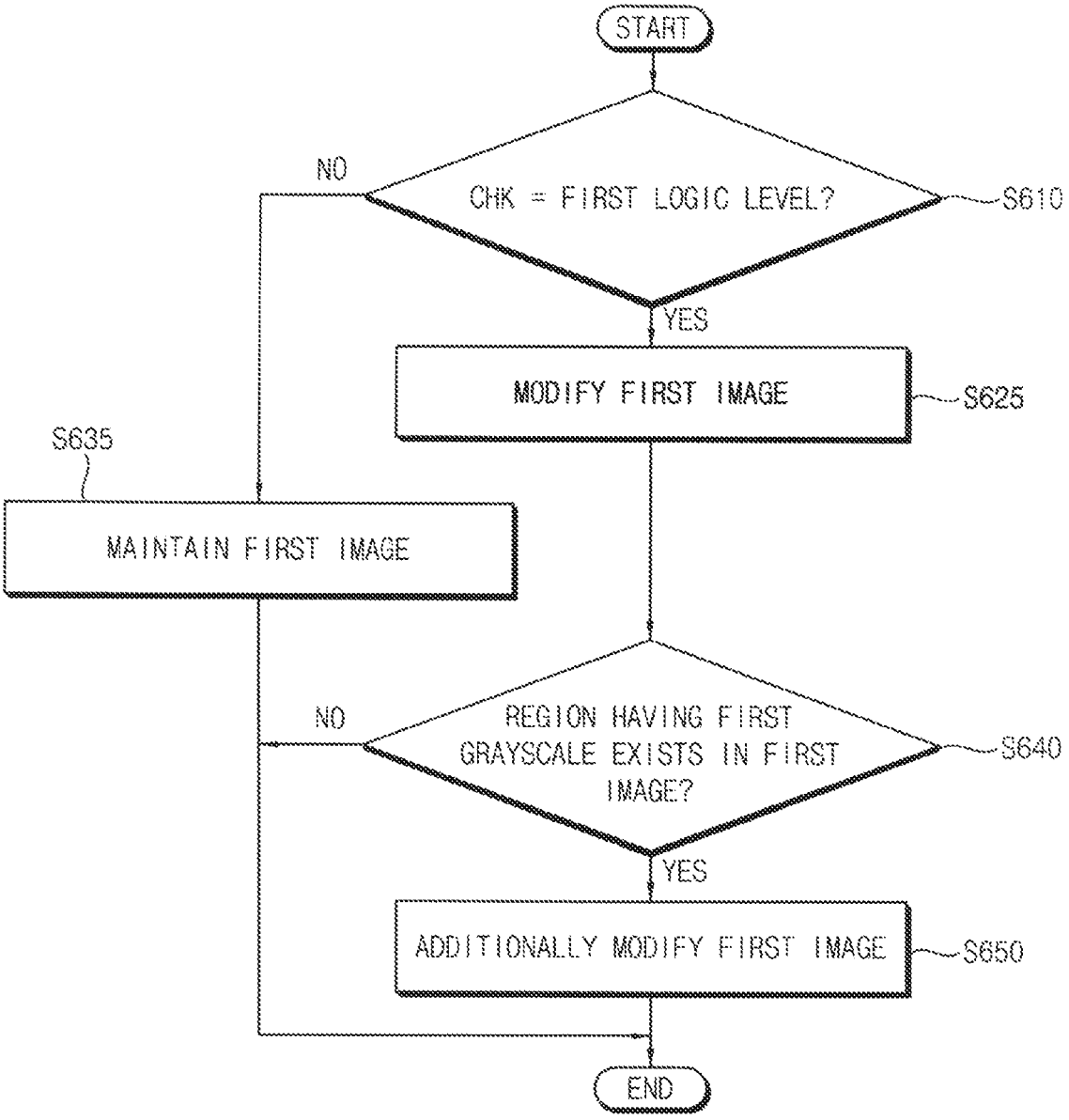
FIG. 29 is a flow chart illustrating another example of step S600 in FIG. 25.

FIG. 29 is a flow chart illustrating another example of step S600 in FIG. 25.

Referring to FIGS. 17A, 17B, 17C, 18A, 18B, 25 and 29, in step S600, the selective modifying operation may be performed in units of a frame image and for a partial region of a frame image.

If the check signal has the first logic level (step S610: YES), the first image IMG21 or IMG31 is modified (step S625). For example, the first region PI1' in the modified first image IMG21' or IMG31' may have a first grayscale that is higher than the grayscale of the first region PI1 in the first image IMG21 or IMG31.

If the check signal has the first logic level (step S610: NO), the first image IMG21 or IMG31 is not modified and is maintained (step S635). In this example, the first image IMG21 or IMG31 and the second image IMG22 may be sequentially and continuously displayed.

After step S625, it is further determined whether another region having the first grayscale exists in the first image IMG21 or IMG31 (step S640).

If a grayscale of the second region PI3 in the first image IMG31 is the first grayscale (step S640: YES), the first image IMG31 is additionally modified (step S650). For example, the second region PI3' in the modified first image IMG31' may have a second grayscale that is higher than the first grayscale. In this example, the additionally modified first image IMG31' and the second image IMG22 may be sequentially and continuously displayed.

If another region having the first grayscale does not exist in the first image IMG21 (step S640: NO), the first image IMG21 is not additionally modified. In this example, the modified first image IMG21' and the second image IMG22 may be sequentially and continuously displayed.

In an exemplary embodiment, the grayscale checking operation is performed by the timing controller included in the display apparatus, and the selective modifying operation is performed by one of the timing controller and the data driver included in the display apparatus.

Figure 30:
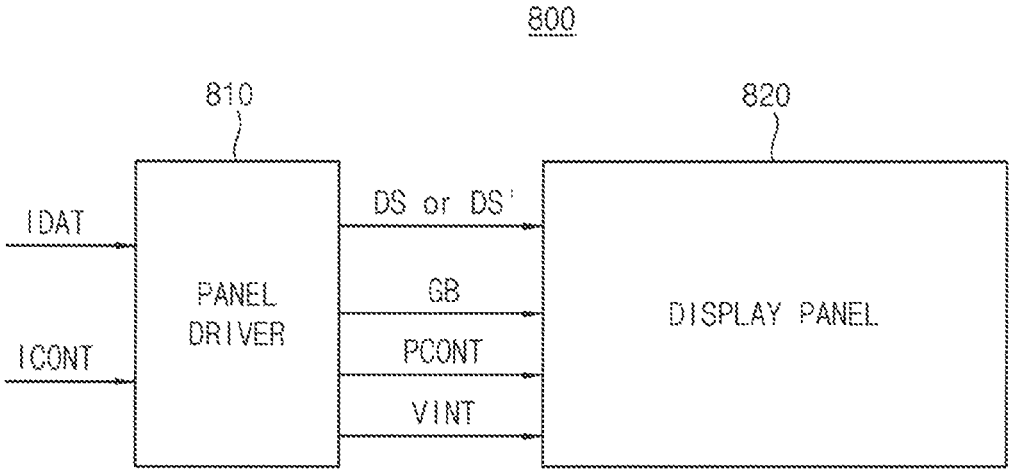
FIG. 30 is a block diagram illustrating a display apparatus according to an exemplary embodiment of the inventive concept.

FIG. 30 is a block diagram illustrating a display apparatus according to exemplary embodiments.

Referring to FIG. 30, a display apparatus 800 includes a panel driver 810 and a display panel 820.

As described with reference to FIGS. 1 through 12, the display apparatus 800 performs the selective BCB operation by checking a grayscale of a current image or grayscales of the current image and a next image, and by selectively applying an initialization voltage VINT to an OLED in each pixel based on a result of the grayscale checking operation. In addition, as described with reference to FIGS. 13 through 29, the display apparatus 800 further checks the grayscales of the current image and the next image when a scene change occurs, and selectively modifies the grayscale of the current image based on a result of the grayscale checking operation.

For example, the panel driver 810 performs a grayscale checking operation on a single image (e.g., a first image) or two consecutive images (e.g., the first image and a second image) based on a first data signal among a plurality of data signals DS or DS', generates a first initialization control signal among a plurality of initialization control signals GB based on the result of the grayscale checking operation. If the first initialization control signal is activated, a first initialization unit included in a first pixel is enabled, and the initialization voltage VINT is applied to a first OLED included in the first pixel while the first image is displayed. In addition, the panel driver 810 performs the grayscale checking operation on two consecutive images (e.g., the first and second images) based on the first data signal, and performs a selective modifying operation on the first image based on the result of the grayscale checking operation.

Figure 31:
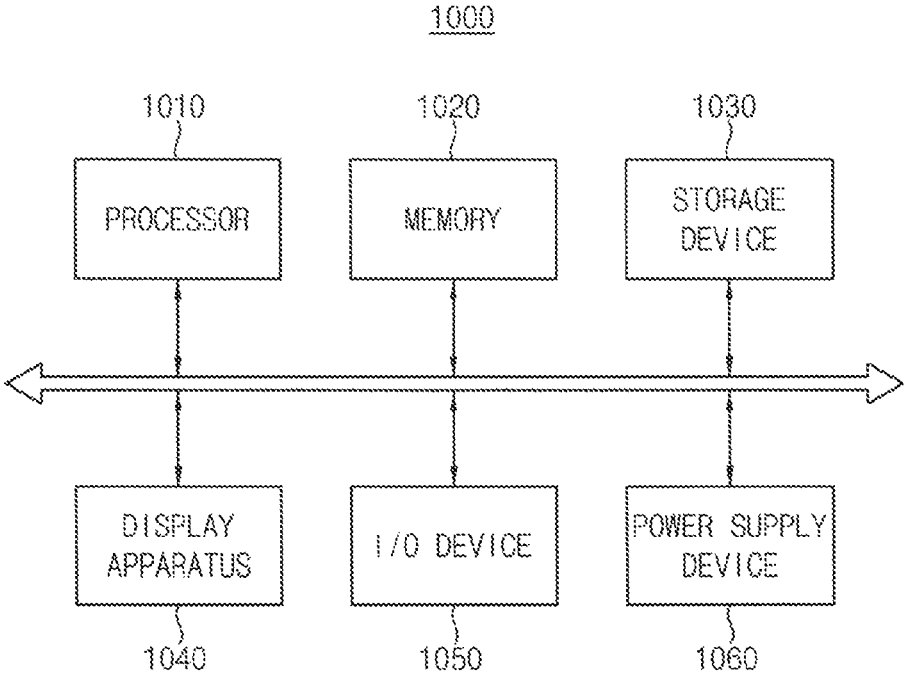
FIG. 31 is a block diagram illustrating an electronic system including the display apparatus according to an exemplary embodiment of the inventive concept.
Figure 32A:
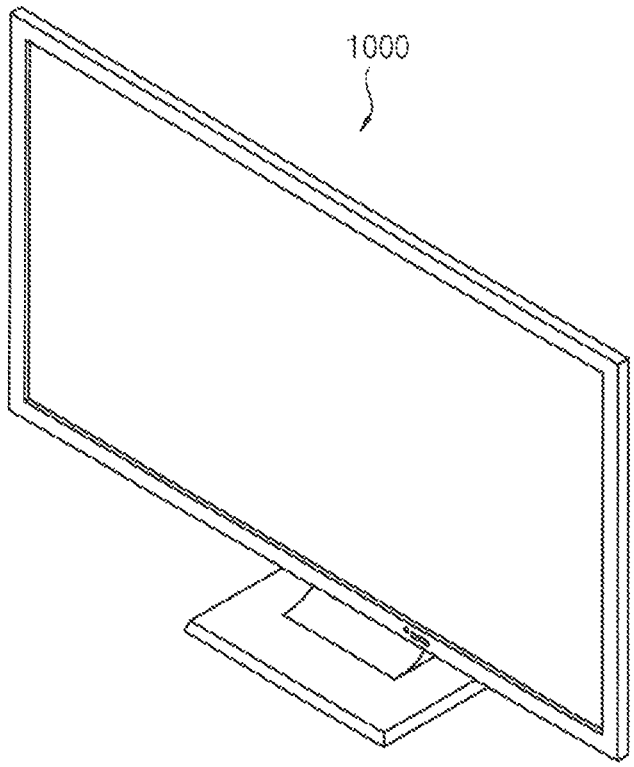
FIGS. 32A and 32B are diagrams illustrating examples of the electronic system of FIG. 31.
Figure 32B:
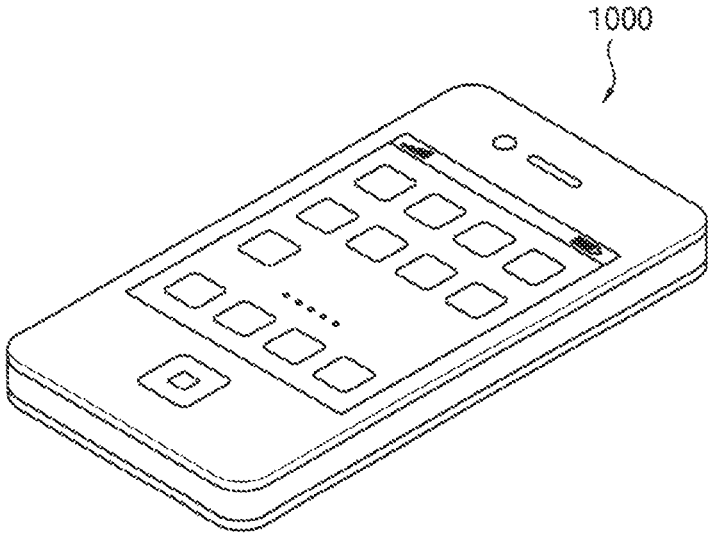

FIG. 31 is a block diagram illustrating an electronic system including the display apparatus according to an exemplary embodiment of the inventive concept. FIGS. 32A and 32B are diagrams illustrating examples of the electronic system of FIG. 31.

Referring to FIGS. 31, 32A and 32B, an electronic system 1000 includes a processor 1010, a memory 1020, a storage device 1030, a display apparatus 1040, an input/output (I/O) device 1050 and a power supply device 1060.

In an exemplary embodiment, as illustrated in FIG. 32A, the electronic system 1000 is implemented as a television. As illustrated in FIG. 32B, the electronic system 1000 may be implemented as a smart phone. Although not illustrated in FIGS. 32A and 32B, the electronic system 1000 may be any computing system, such as a personal computer (PC), a server computer, a workstation, a digital television, a set-top box, etc., and/or may be any mobile system, such as a mobile phone, a smart phone, a tablet computer, a laptop computer, a personal digital assistants (PDA), a portable multimedia player (PMP), a digital camera, a portable game console, a music player, a camcorder, a video player, a navigation system, etc. The mobile system may further include a wearable device, an internet of things (IoT) device, an internet of everything (IoE) device, an e-book, a virtual reality (VR) device, an augmented reality (AR) device, a robotic device, etc.

The processor 1010 may perform various computational functions such as particular calculations and tasks. For example, the processor 1010 may be a central processing unit (CPU), a microprocessor, an application processor (AP), etc.

The memory 1020 and the storage device 1030 may store data required for operating the electronic system 1000 and/or data processed by the processor 1010. For example, the memory 1020 may include a volatile memory such as a dynamic random access memory (DRAM), a static random access memory (SRAM), etc., and/or a non-volatile memory such as an electrically erasable programmable read-only memory (EEPROM), a flash memory, a phase change random access memory (PRAM), a resistance random access memory (RRAM), a magnetic random access memory (MRAM), a ferroelectric random access memory (FRAM), a nano floating gate memory (NFGM), or a polymer random access memory (PoRAM), etc. The storage device 1030 may include a CD-ROM, a hard disk drive (HDD), a solid state drive (SSD), etc.

The I/O device 1050 may include at least one input device such as a keypad, a button, a microphone, a touch screen, etc., and/or at least one output device such as a speaker, a printer, etc. The power supply device 1060 may provide power to the electronic system 1000.

The display apparatus 1040 may be one of the above-described display apparatuses (e.g., 10, 70, 800, etc.) according to exemplary embodiments. In an exemplary embodiment, the display apparatus 1040 performs the selective BCB operation by checking a grayscale of a current image or grayscales of the current image and a next image, and by selectively applying an initialization voltage to an OLED in each pixel based on a result of the grayscale checking operation as described with reference to FIGS. 1 through 12. In other exemplary embodiments, the display apparatus 1040 checks the grayscales of the current image and the next image when a scene change occurs, and selectively modifies the grayscale of the current image based on a result of the grayscale checking operation as described with reference to FIGS. 13 through 29. In still other exemplary embodiments, the display apparatus 1040 substantially simultaneously or concurrently performs such operations as described with reference to FIG. 30. Accordingly, display defects may be prevented, and the display apparatus 1040 may have a relatively improved display quality.

The above described embodiments may be used in a display apparatus and/or a system including the display apparatus, such as a mobile phone, a smart phone, a PDA, a PMP, a digital camera, a digital television, a set-top box, a music player, a portable game console, a navigation device, a PC, a server computer, a workstation, a tablet computer, a laptop computer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display apparatus comprising:

a display panel comprising a first pixel including a first organic light emitting diode (OLED); and a panel driver configured to apply a first voltage to an anode electrode of the first OLED while a first frame image is displayed on the display panel when a grayscale of the first frame image is lower than a first reference grayscale and a grayscale of a second frame image is higher than a second reference grayscale, wherein the first and second images are two consecutive images, and wherein the first voltage is an initialization voltage for resetting the first OLED, wherein the second reference grayscale is greater than the first reference grayscale.

2. The display apparatus of claim 1, wherein the first pixel further comprises:

a first transistor connected between the anode electrode of the first OLED and a node receiving the initialization voltage, the first transistor having a gate electrode receiving a first initialization control signal.

3. The display apparatus of claim 2, wherein the panel driver comprises:

a data driver configured to generate a first data signal based on image data corresponding to the first frame image; and an initialization controller configured to generate the first initialization control signal by checking the grayscale of the first frame image based on the first data signal.

4. The display apparatus of claim 3, wherein the initialization controller comprises:

a comparator including a first input terminal receiving the first data signal, a second input terminal receiving a first reference signal corresponding to the first reference grayscale, a third input terminal receiving a second reference signal corresponding to the second reference grayscale, and an output terminal outputting the first initialization control signal.

5. The display apparatus of claim 4, wherein when a voltage level of the first data signal is higher than a voltage level of the first reference signal and a voltage level of the second data signal is lower than a voltage level of the second reference signal, the initialization controller determines that the grayscale of the first frame image is lower than the first reference grayscale and the grayscale of the second frame image is higher than the second reference grayscale to activate the first initialization control signal, wherein the initialization voltage is applied to the anode electrode of the first OLED when the first initialization control signal is activated.

6. The display apparatus of claim 3, wherein the initialization controller is disposed on the display panel.

7. The display apparatus of claim 3, wherein the initialization controller is disposed within the data driver.

8. The display apparatus of claim 1, wherein the panel driver receives a data signal from an output of a transistor of the first pixel controlled by a scan signal to determine how the grayscales of the frame images compare to the reference grayscales.

9. A method of operating a display apparatus comprising a display panel including a first pixel, the method comprising:

comparing a grayscale of a first frame image applied to the display panel with a first reference grayscale;

comparing a grayscale of a second frame image applied to the display panel with a second reference grayscale, the first and second frame images being two consecutive images;

applying a first voltage to an anode electrode of a first organic light emitting diode (OLED) included in the first pixel while the first frame image is displayed on the display panel when a result of the comparing of the first frame image indicates the grayscale of the first frame image is lower than the first reference grayscale and a result of the comparing of the second frame image indicates the grayscale image of the second frame image is higher than the second reference grayscale, wherein the first voltage is an initialization voltage for resetting the first OLED, wherein the second reference grayscale is greater than the first reference grayscale.

10. The method of claim 9, wherein comparing the grayscale of the first frame image with the first reference grayscale comprises: generating a first data signal based on image data corresponding to the first frame image, wherein comparing the grayscale of the second frame image with the second reference grayscale comprises: generating a second data signal based on image data corresponding to the second frame image, the method further comprising: generating a first initialization control signal by comparing the first data signal with a first reference signal corresponding to the first reference grayscale and comparing the second data signal with a second reference signal corresponding to the second reference grayscale.

11. The method of claim 10, wherein when a voltage level of the first data signal is higher than a voltage level of the first reference signal and a voltage level of the second data signal is lower than a voltage level of the second reference signal, it is determined that the grayscale of the first frame image is lower than the first reference grayscale and the grayscale of the second frame image is higher than the second reference grayscale to activate the first initialization control signal, wherein the initialization voltage is applied to the anode electrode of the first OLED when the first initialization control signal is activated.

12. A display apparatus comprising:

a display panel comprising a first pixel, the first pixel including:

a first organic light emitting diode (OLED); and a first initialization circuit connected to the first OLED; and a panel driver configured to generate a first initialization control signal by comparing a grayscale of a first partial image applied to the first pixel with a first reference grayscale and by comparing a grayscale of a second partial image applied to the first pixel with a second reference grayscale, wherein when the first initialization control signal is activated, the first initialization circuit is enabled and applies an initialization voltage to the first OLED to reset the OLED while the first partial image is displayed on the first pixel, wherein the first and second partial images are two consecutive images, wherein the panel driver comprises a comparator including a first input terminal receiving a first data signal corresponding to the first partial image during a first time and a second data signal corresponding to the second partial image during a second time, a second input terminal receiving a first reference signal corresponding to the first reference grayscale, a third input terminal receiving a second reference signal corresponding to the second reference grayscale, and an output terminal outputting the first initialization control signal.

13. The display apparatus of claim 12, wherein the panel driver activates the first initialization control signal when the grayscale of the first partial image is lower than the first reference grayscale and the grayscale of the second partial image is higher than the second reference grayscale.

14. The display apparatus of claim 13, wherein the panel driver determines that the grayscale of the first partial image is lower than the first reference grayscale when a voltage level of a first data signal corresponding to the first partial image is higher than a voltage level of the first reference signal corresponding to the first reference grayscale.

15. The display apparatus of claim 12, wherein the panel driver comprises:

a data driver configured to generate the first data signal corresponding to the first partial image and the second data signal corresponding to the second partial image, based on image data.

16. The display apparatus of claim 15, wherein the initialization controller is disposed on the display panel.

17. The display apparatus of claim 15, wherein the initialization controller is disposed within the data driver.

18. The display apparatus of claim 12, wherein the first initialization circuit comprises:

a first transistor connected between an anode electrode of the first OLED and a node receiving the initialization voltage, the first transistor having a gate electrode receiving the first initialization control signal.

19. The display apparatus of claim 18, wherein the initialization voltage is applied to the anode electrode of the first OLED.

20. A display apparatus comprising:

a display panel comprising a pixel including a first transistor having a first non-gate electrode connected to a node receiving a first data signal and an organic light emitting diode (OLED); and a controller configured to receive a second data signal output by a second non-gate electrode of the first transistor, wherein the controller is configured to selectively disable the OLED based on how the second data signal compares to a first reference grayscale and a second reference grayscale that is higher than the first reference grayscale.

21. The display apparatus of claim 20, wherein the controller disables the OLED when a grayscale of the second data signal is less than the first reference grayscale during a first time and greater than the second reference grayscale during a second time.

22. The display apparatus of claim 21, wherein the pixel further comprises a second transistor connected between a node receiving a voltage configured to reset the OLED and an anode electrode of the OLED, and the controller applies a signal to a gate electrode of the second transistor to disable the OLED.

* * * * *